US011576441B2

(12) United States Patent
Baravarian

(10) Patent No.: US 11,576,441 B2
(45) Date of Patent: Feb. 14, 2023

(54) SOCK WITH SUPPORT ASSEMBLAGE

(71) Applicant: SOKSYSTEM, LLC, Beverly Hills, CA (US)

(72) Inventor: Babak Baravarian, Beverly Hills, CA (US)

(73) Assignee: SOKSYSTEM, LLC, Beverly Hills, CA (US)

( * ) Notice: Subject to any disclaimer, the term of this patent is extended or adjusted under 35 U.S.C. 154(b) by 348 days.

(21) Appl. No.: 16/526,953

(22) Filed: Jul. 30, 2019

(65) Prior Publication Data

US 2019/0350273 A1 Nov. 21, 2019

Related U.S. Application Data

(63) Continuation-in-part of application No. 16/121,492, filed on Sep. 4, 2018, now Pat. No. 10,362,811, which is a continuation-in-part of application No. 15/224,626, filed on Jul. 31, 2016, now Pat. No. 10,149,500, which is a continuation of application No. 14/161,632, filed on Jan. 22, 2014, now Pat. No. 9,439,457.

(51) Int. Cl.
*A41B 11/02* (2006.01)
*A41B 11/00* (2006.01)

(52) U.S. Cl.
CPC ..... *A41B 11/02* (2013.01); *A41B 11/003* (2013.01)

(58) Field of Classification Search
CPC ..... A41B 11/02; A41B 11/003
See application file for complete search history.

(56) References Cited

U.S. PATENT DOCUMENTS

| | | | |
|---|---|---|---|
| 2,144,563 | A | 1/1939 | Davis |
| 4,172,456 | A | 10/1979 | Zens |
| 4,255,949 | A | 3/1981 | Thorneburg |
| 4,277,959 | A | 7/1981 | Thorenburg |
| 4,476,858 | A | 10/1984 | Curtis |
| 4,520,635 | A | 6/1985 | Shields et al. |
| 4,811,727 | A | 3/1989 | Etienne |
| 5,092,347 | A | 5/1992 | Shaffer |

(Continued)

FOREIGN PATENT DOCUMENTS

| | | |
|---|---|---|
| EP | 0227566 | 7/1987 |
| WO | 2014057176 | 4/2014 |

*Primary Examiner* — Khaled Annis
(74) *Attorney, Agent, or Firm* — Jafari Law Group, Inc.

(57) ABSTRACT

The present invention relates generally to a sock having one or more support assemblages for providing structural support to one or more regions of the foot of the wearer. In some exemplary embodiments, a support assemblage may be an arch support assemblage that is adapted to cover an arch of the foot. In some exemplary embodiments, a support assemblage may be an Achilles support assemblage that is adapted to cover the Achilles tendon of the foot. In some exemplary embodiments, a support assemblage may be an ankle support assemblage that is adapted to cover a portion of the ankle of the foot. In some exemplary embodiments, the sock may comprise multiple support assemblages to provide structural support to different regions of the foot of the wearer. Typically, a support assemblage will have an elasticity coefficient that is lower than an elasticity coefficient of the other areas of the sock.

13 Claims, 17 Drawing Sheets

(56) References Cited

U.S. PATENT DOCUMENTS

| | | | | |
|---|---|---|---|---|
| 5,133,088 | A | 7/1992 | Dunlap | |
| 5,640,714 | A | 6/1997 | Tanaka | |
| 5,771,495 | A | 6/1998 | Turner et al. | |
| 5,898,948 | A * | 5/1999 | Kelly | A41B 11/00 2/239 |
| 6,012,177 | A | 1/2000 | Cortinovis | |
| 6,324,874 | B2 | 12/2001 | Fujimoto | |
| 6,668,387 | B2 | 12/2003 | Kalde | |
| 7,007,517 | B2 | 3/2006 | Menzies | |
| 7,441,419 | B1 | 10/2008 | Dollyhite et al. | |
| 7,677,061 | B2 | 3/2010 | Mori et al. | |
| 7,681,254 | B2 | 3/2010 | Lambertz | |
| D657,122 | S | 4/2012 | Gaither | |
| 8,424,117 | B2 | 4/2013 | Hasan et al. | |
| 9,226,527 | B2 | 1/2016 | Dahlgren | |
| 9,636,261 | B2 | 5/2017 | Mitsuno | |
| 9,713,349 | B2 | 7/2017 | Campbell | |
| 2009/0113602 | A1 | 5/2009 | Lambertz | |
| 2010/0042032 | A1 | 2/2010 | Tomczak | |
| 2011/0082403 | A1 | 4/2011 | Hill | |
| 2011/0296588 | A1 | 12/2011 | Cummings | |
| 2012/0102613 | A1 | 5/2012 | Loth | |
| 2013/0035625 | A1 | 2/2013 | Kobayashi | |
| 2016/0242946 | A1 | 8/2016 | Gambardella | |
| 2017/0354543 | A1 | 12/2017 | Mazourik | |

* cited by examiner

SOCK WITH SUPPORT ASSEMBLAGE

PRIORITY NOTICE

The present application is a continuation-in-part of U.S. patent application Ser. No. 16/121,492, filed Sep. 4, 2018, which is a continuation-in-part of U.S. patent application Ser. No. 15/224,626, filed Jul. 31, 2016, which is a continuation of U.S. patent application Ser. No. 14/161,632, filed on Jan. 22, 2014, the disclosure of which are incorporated herein by reference in their entirety.

TECHNICAL FIELD OF THE INVENTION

The present invention relates in general to a sock with one or more support assemblages, which provides additional structural support and stability to one or more regions of the foot.

COPYRIGHT & TRADEMARK NOTICE

A portion of the disclosure of this patent application may contain material that is subject to copyright protection. The owner has no objection to the facsimile reproduction of any one of the patent documents or the patent disclosure as it appears in the Patent and Trademark Office patent file or records, but otherwise reserves all copyrights whatsoever. Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

For centuries, stockings or socks have been used to provide comfort and warmth and protect the feet from cracking, dryness, chafing, or general damage that can result from continually rubbing up against one's footwear or, if barefoot, the surrounding environment. More recently, sock entrepreneurs have especially begun focusing on the comfort aspect of sock wearing, for example designing thinner socks that allow for greater airflow or thicker socks that provide greater padding. Thicker socks often employ terry loops to provide greater moisture absorption in addition to increased cushioning. Some prior art has employed terry loops only in particular areas of the sock or simply with greater density in those areas so as to soften the impact of the foot as it makes contact with the ground while walking or otherwise mobile on foot. Prior art has taken this approach with many areas of the foot, including the Achilles tendon, sole, heel, and toes, but seldom the arch or the arch side of the foot. Yet among the enumerated, the arch is of great importance.

The arch region principally resides in the inner-middle part of each foot and is predominately comprised of or reliant on the tarsal and metatarsal bone set and various tendons and ligaments to support the weight of the entire human body when erect. Therefore, it is unsurprising that the arch undergoes immense strain and pressure, which can become quite problematic for a person, especially when the arch is not being supported sufficiently by socks or footwear. But despite its importance, the prior art neglect to solely provide support for the arch (inner) side of the foot. Moreover, the prior art emphasizes cushioning to the exclusion of structural support, an important distinction with even more important consequences. While cushioning may ameliorate pain associated with walking or running, structural deficiencies are all but ignored and untreated.

Thus, persons with, for example, plantar fasciitis or low or flat foot arches, would likely make very limited improvement by wearing cushioning socks, but could greatly benefit from socks with improved arch regions in light of the problems presented by the prior art. Hence, there is a need in the art for an arch-supporting sock, which reduces pain and strain in the arch regions of the feet and reinforces proper curvature of the arch, whereby other areas important for standing and mobility such as the heel or lower leg are positively impacted as well.

Similarly, the prior art inadequately addresses providing for improved structural support to the ankle and or the Achilles tendon of the foot of the wearer. While the prior art includes several structures such as pads, pockets with padded inserts, and cushioning layers that cover these regions of the foot, these prior art structures either improperly support these regions, comprise of components too cumbersome for easy manufacturing, or simply do not provide adequate support.

Therefore, the present invention seeks to address the inadequacies and shortcomings of the prior art, by providing a sock with one or more support assemblages, which provides additional structural support and stability to different regions of the foot.

It is to these ends that the present invention has been developed.

SUMMARY OF THE INVENTION

To minimize the limitations in the prior art, and to minimize other limitations that will be apparent upon reading and understanding the present specification, the present invention describes an arch-supporting sock used to reduce pain and strain in the arch region of the foot and stabilize and reinforce proper curvature of the arch.

Generally, the present invention is a sock having one or more support assemblages for providing structural support to one or more regions of the foot of the wearer. In some exemplary embodiments, a support assemblage may be an arch support assemblage that is adapted to cover an arch of the foot. In some exemplary embodiments, a support assemblage may be an Achilles support assemblage that is adapted to cover the Achilles tendon of the foot. In some exemplary embodiments, a support assemblage may be an ankle support assemblage that is adapted to cover a portion of the ankle of the foot. In some exemplary embodiments, the sock may comprise multiple support assemblages to provide structural support to different regions of the foot of the wearer. Typically, a support assemblage will have an elasticity coefficient that is lower than an elasticity coefficient of the other areas of the sock.

A sock, in accordance with some embodiments of the present invention, may include a sock body defined by a toe section, a heel flap, a sole extending between the toe section and the heel flap on a bottom portion of the sock, and an instep extending between the toe section and the heel flap on a top portion of the sock, the toe section and instep having a first elasticity coefficient; an arch support assemblage, adapted to cover an arch region of the sole of the sock excluding the toe section of the sock, the arch support assemblage having a second elasticity coefficient, wherein the second elasticity coefficient is lower than the first elasticity coefficient; and an Achilles support assemblage, adapted to cover an Achilles tendon of a wearer of the sock, the Achilles support assemblage running from a top edge of the heel flap to a top portion of the leg of the sock.

A sock, in accordance with some embodiments of the present invention, may include: a sock body defined by a toe section, a heel flap, a sole extending between the toe section and the heel flap on a bottom portion of the sock, and an instep extending between the toe section and the heel flap on a top portion of the sock, the toe section and instep having a first elasticity coefficient; and an Achilles support assemblage, adapted to cover an Achilles tendon of a wearer of the sock, the Achilles support assemblage running from a top edge of the heel flap to a top portion of the leg of the sock, the Achilles support assemblage having a second elasticity coefficient that is lower than the first elasticity coefficient.

A sock, in accordance with some embodiments of the present invention, may include: a sock body defined by a toe section, a heel flap, a sole extending between the toe section and the heel flap on a bottom portion of the sock, and an instep extending between the toe section and the heel flap on a top portion of the sock, the toe section and instep having a first elasticity coefficient; an arch support assemblage, adapted to cover an arch region of the sole of the sock excluding the toe section of the sock, the arch support assemblage having a second elasticity coefficient, wherein the second elasticity coefficient is lower than the first elasticity coefficient; an Achilles support assemblage, adapted to cover an Achilles tendon of a wearer of the sock, the Achilles support assemblage running from a top edge of the heel flap to a top portion of the leg of the sock; and an ankle support assemblage adapted to cover a portion of an ankle of the wearer of the sock, including a pair of bands extending from the Achilles support assemblage to a distal end of the heel flap of the sock, wherein at least one of the pair of bands of the ankle support assemblage wraps around the sole of the sock connecting with a posterior region of the arch support assemblage.

An arch-supporting sock, in accordance with one embodiment of the present invention, comprises: a first region having a first elasticity coefficient; and a second region, roughly encompassing the arch of the foot, having a second elasticity coefficient for providing structural support, wherein the second elasticity coefficient is lower than the first elasticity coefficient.

An arch-supporting sock, in accordance with another embodiment of the present invention, comprises: a first region having a first elasticity coefficient; and a second region, roughly encompassing the arch of the foot; and one or more perimetric boundaries between the first region and the second region, each perimetric boundary comprising a perimetric elasticity coefficient, wherein at least one of the one or more perimetric boundaries has a perimetric elasticity coefficient less than the first elasticity coefficient.

An arch-supporting sock, in accordance with yet another embodiment of the present invention, comprises: a first terry loop region having a first elasticity coefficient; a second tuck-stitched region, roughly encompassing the arch of the foot, having a second elasticity coefficient for providing structural support, wherein the second elasticity coefficient is lower than the first elasticity coefficient; and one or more perimetric boundaries between the first region and the second region, each boundary comprising a perimetric elasticity coefficient, wherein the one or more perimetric boundaries have a perimetric elasticity coefficient less than the first and second elasticity coefficients.

It is an objective of the present invention to support the arch region of the foot without forfeiting comfort.

It is another objective of the present invention to provide a plurality of types of socks for different occasions and circumstances.

It is yet another objective of the present invention to support the Achilles tendon or posterior region of the foot without forfeiting comfort.

It is yet another objective of the present invention to support the ankle of the foot without forfeiting comfort.

It is yet another objective of the present invention to provide a sock with additional structural support and stability to different regions of the foot.

It is yet another objective of the present invention to reinforce proper curvature of the arch region.

It is yet another objective of the present invention to provide a wedge support of the inner half of the foot and thereby raise the medial longitudinal arch with respect to the outer half of the foot.

Finally, it is yet another objective of the present invention to alleviate pain and decrease strain in the heel, arch and greater foot region.

These and other advantages and features of the present invention are described herein with specificity so as to make the present invention understandable to one of ordinary skill in the art.

BRIEF DESCRIPTION OF THE DRAWINGS

The socks with support assemblages as disclosed herein are further described in terms of exemplary embodiments. These exemplary embodiments are described in detail with reference to the drawings, which have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. These embodiments are non-limiting exemplary embodiments, in which like reference numerals represent similar structures throughout the several views of the drawings. The drawings that accompany the detailed description can be briefly described as follows:

FIG. 3(*b*) is a side view of a foot with a flat arch, wherein the bottom of the arch is in contact with the ground.

FIG. 4(*b*) is a side view of a left ankle-length sock, in accordance with one embodiment of the present invention.

FIG. 5(*b*) is a side view of a left liner-length sock, in accordance with one embodiment of the present invention.

FIG. 10(*b*) is a perspective side view of the sock in FIG. 10(*a*), in accordance with an exemplary embodiment of the present invention.

FIG. 10(*c*) is a cross-sectional side view of the sock in FIGS. 10(*a*)-10(*b*), in accordance with an exemplary embodiment of the present invention.

FIG. 11(*b*) is a perspective side view of the sock in FIG. 11(*a*), in accordance with an exemplary embodiment of the present invention.

FIG. 11(*c*) is a cross-sectional side view of the sock in FIGS. 11(*a*)-11(*b*), in accordance with an exemplary embodiment of the present invention.

FIG. 12(*b*) is a perspective side view of the sock in FIG. 12(*a*), in accordance with an exemplary embodiment of the present invention.

FIG. 12(*c*) is a cross-sectional side view of the sock in FIGS. 12(*a*)-12(*b*), in accordance with an exemplary embodiment of the present invention.

FIG. 13(*b*) is a side view of the sock in FIG. 13(*a*), in accordance with an exemplary embodiment of the present invention.

FIG. 13(*c*) is a bottom view of the sock in FIGS. 13(*a*)-13(*b*).

FIG. 14(*b*) is a side view of the sock in FIG. 14(*a*), in accordance with an exemplary embodiment of the present invention.

FIG. 15(*b*) is a bottom view of the sock in FIG. 15(*a*).

DETAILED DESCRIPTION OF THE DRAWINGS

Figure 1:
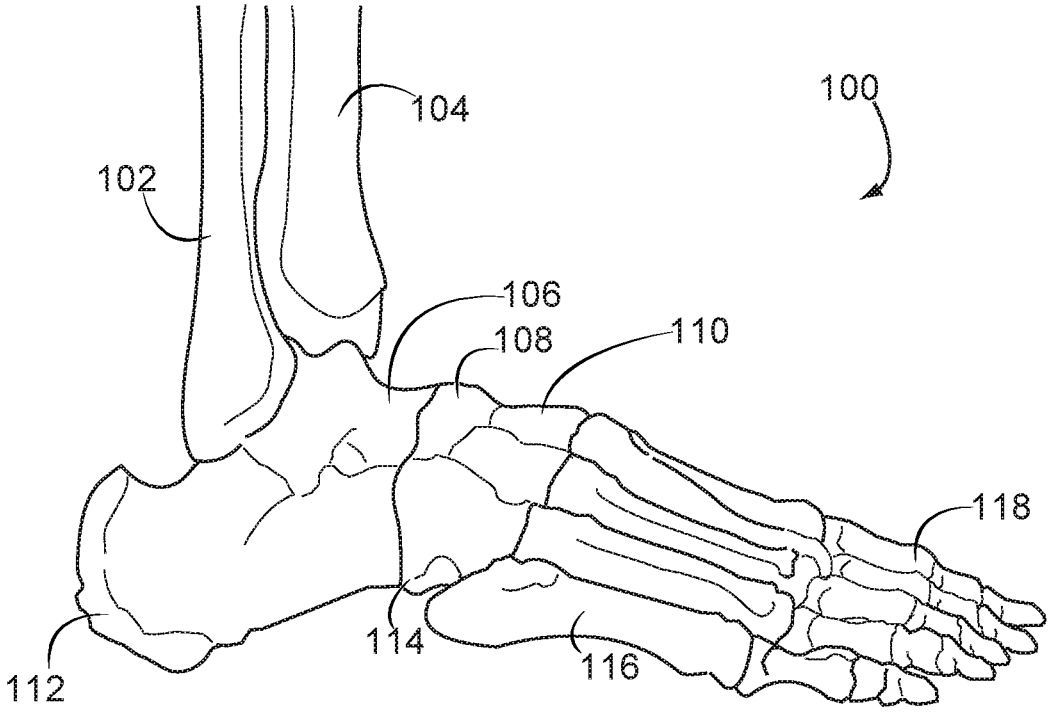
FIG. 1 is a side elevation view of the bones of the lower leg and foot.

In the following discussion that addresses a number of embodiments and applications of the present invention, reference is made to the accompanying figures, which form a part thereof. Depictions are made, by way of illustration, of specific embodiments in which the invention may be practiced; however, it is to be understood that other embodiments may be utilized and changes may be made without departing from the scope of the present invention.

In the following detailed description, numerous specific details are set forth by way of examples in order to provide a thorough understanding of the relevant teachings. However, it should be apparent to those skilled in the art that the present teachings may be practiced without such details. In other instances, well-known structures, components, and/or functional or structural relationship thereof, etc., have been described at a relatively high level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example," as used herein, does not necessarily refer to the same embodiment. It is intended, for example, that the claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments, whether these features, elements, and/or steps are included or are to be performed in any particular embodiment.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc., may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can include only A, some embodiments can include only B, some embodiments can include only C, and some embodiments can include A, B, and C. The term "and/or" is used to avoid unnecessary redundancy. Similarly, terms such as "a," "an," or "the," again, may be understood to convey a singular usage or to convey a plural usage, depending at least in part upon context. In addition, the term "based on" may be understood as not necessarily intended to convey an exclusive set of facts and may, instead, allow of the existence of additional facts not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods, Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Turning now to the figures, FIG. 1 serves as an introduction to the physical features, namely the bones, which comprise the arch of the foot and other relevant foot and leg bones, so as to provide greater context and understanding to the scope and purpose of the present invention. FIG. 1 is a side view of the bones of the lower leg and foot. The relevant bones of the lower leg and foot 100 consist of talus 106, calcaneus 112, fibula 102, tibia 104, cuboid 114, navicular 108, cuneiforms 110, metatarsals 116, and phalanges 118. Calcaneus 112, talus 106, cuboid 114, navicular 108, and the three cuneiforms 110 form what is referred to as the tarsals. Only two of the three cuneiforms 110 are visible, with the third hidden cuneiform 110 residing on the line of bones ending distally with the big toe, also referred to as the hallux.

For the purposes of simplicity, the foot can also be categorized into its relative regions: the hindfoot, midfoot, and forefoot, listed from proximal to distal end. The hindfoot comprises calcaneus 112 and talus 106. The midfoot comprises five important bones, two of which are cuboid 114 and navicular 108, and three of which are cuneiforms 110, together outlining the area of interest: the arch region. The forefoot comprises metatarsals 116, which are the five bones connecting the midfoot to the toe bones, and the toe bones themselves, referred to as phalanges 118. The hallux has two phalanges 118, whereas the remaining four toes are comprised of three phalanges 118. Tibia 104 and fibula 102 do not make up part of foot 100 and are instead long bones of the lower leg, though both tibia 104 and fibula 102 impact and are impacted by the arch region and its constituents.

Figure 2:
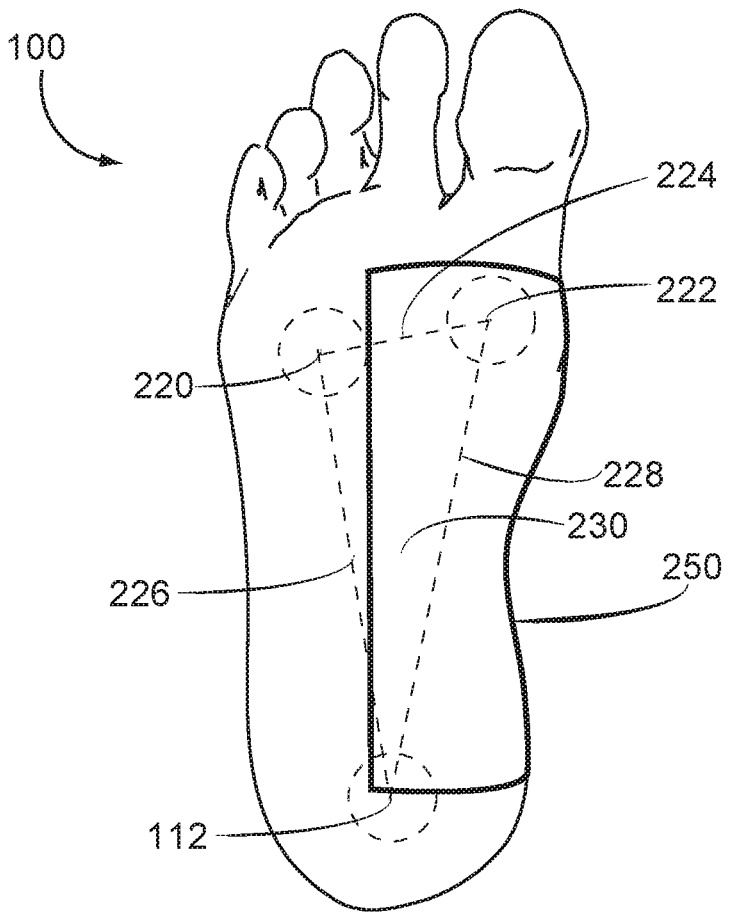
FIG. 2 is a plantar view of the underside of a human foot.

FIG. 2 is a plantar view of the underside of a foot. The figure displays the three primary arches of the human foot as well as a visual approximation of the area supported by an arch support assemblage, in accordance with an exemplary embodiment of the present invention. Medial ball 222 refers to the region on the inner part of foot 100 near the distal end of metatarsals 116 between the hallux and the adjacent long toe, wherein medial ball 222 serves as an arch base. Lateral ball 220 refers to the region on the outer part of foot 100 near the distal end of metatarsals 116 between the fifth toe and fourth toe, wherein lateral ball 220 serves as an arch base. The space between medial ball 222 and lateral ball 220, which under normal circumstances resembles an arch structure, is hereby referred to as transverse arch 224. Similarly, the region between medial ball 222 and calcaneus 112, which under normal circumstances resembles an arch structure, is hereby referred to as medial longitudinal arch 228. Also similarly, the region between lateral ball 220 and calcaneus 112, which under normal circumstances resembles an arch structure, is hereby referred to as lateral longitudinal arch 226. Medial longitudinal arch 228 is the inner-most arch of the three enumerated arches, typically receiving more intense stress than lateral longitudinal arch 226 and transverse arch 224. Thus medial longitudinal arch 228 may benefit most from an arch support assemblage lessening stress and strain on the arch region, heel, and medial and lateral balls 222, 220 of foot 100 upon impacting the ground. Furthermore, the part of the sock underlying or roughly covering medial longitudinal arch 228 may have additional material yielding a lower elasticity coefficient than some or all of the other arch supports, a concept elaborated upon in later figures.

Arch support assemblage 250, in accordance with the present exemplary embodiment displayed in FIG. 2, covers a majority of arch region 230, with medial longitudinal arch 228 entirely covered. Thus, arch support assemblage 250 will afford the greatest structural support to the inner, medial portion of foot 100. However, it is important to note that structural support is not limited to arch region 230, since arch support assemblage 250 extends beyond arch region 230. Specifically, in the present embodiment, arch support assemblage 250 extends from the center of the heel, approximated by calcaneus 112, to the end of metatarsals 116 where they reach the start of phalanges 118. Additionally, along the width of foot 100, arch support assemblage 250 reaches from the medial-most part of foot 100 to the vertical boundary between the second and third toes. The scope or area of arch support assemblage 250 may be contracted or expanded without deviating from the spirit or scope of the present invention. For instance, arch support assemblage 250 may extend widthwise to the middle of the third toe, the vertical boundary between the third and fourth toes, or the middle of the second toe to cover more or less of arch region 230. In any case, this may cause the inner or medial half of foot 100 to become slightly wedged or raised by comparison to the outer or lateral half of foot 100. The disparity in support between the inner and outer halves of the feet is representative of the disparity in strain and stress endured by each half of the foot while mobile on foot.

In alternative embodiments, arch support assemblage 250 may cover a slightly larger area of foot 100, perhaps to the vertical boundary between the third and fourth toes, so as to more completely encompass arch region 230. However, even in such wider-reaching embodiments, a disproportionate amount of support is offered to the inner half of foot 100 as compared to the outer half.

Figure 3A:
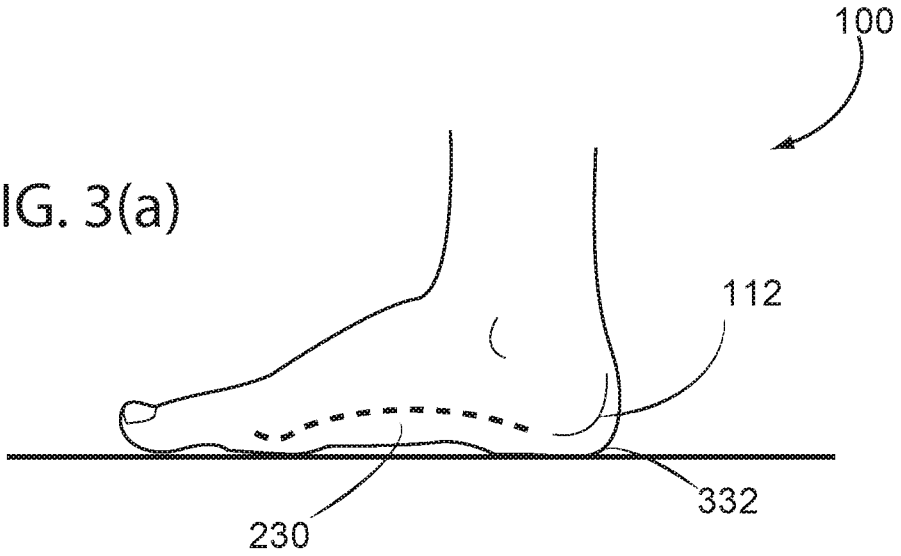
FIG. 3(*a*) is a side view of a foot with a typical arch, wherein the bottom of the arch is not in contact with the ground.
Figure 3B:
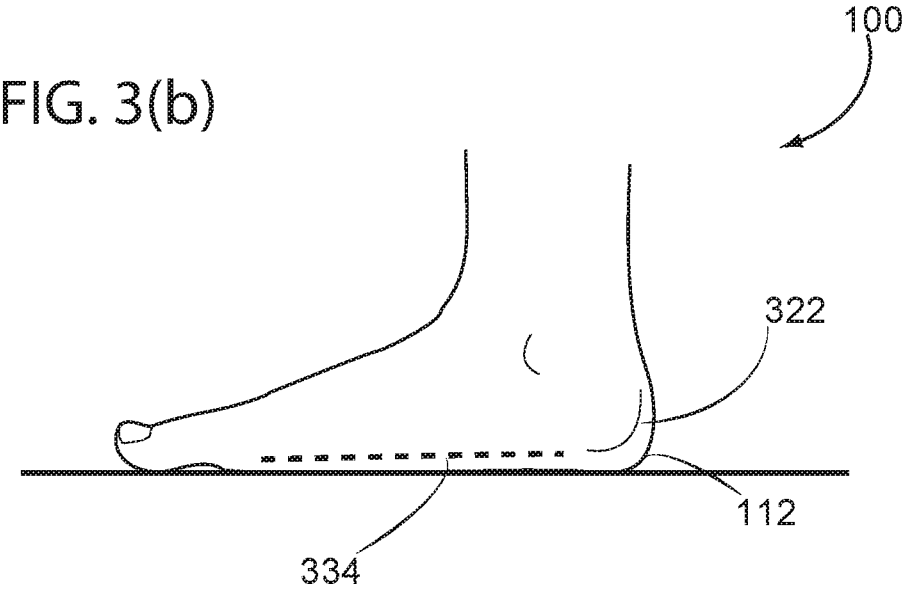

FIG. 3(*a*) is a side view of a foot with a preferable amount of medial foot matter not in contact with the ground, thus forming a normal arch. The approximate proportion and parts of the foot desired to be in contact with the ground in various instances such as when standing, walking, or running would be known by those skilled in the art. Arch region 230, as displayed in FIG. 3(*a*), is of great importance because of its elasticity. When erect, the parts of foot 100 that make up arch region 230, such as the plantar fascia, help spread and extend ground contact out over time, in the process reducing the amount of strain put on the rest of arch region 230, as well as the greater foot area and lower leg. Additionally, support of arch region 230, such as that displayed in the discussed figure, is essential for upright posture longevity. Possessing the ideal or close to the ideal curvature of arch region 230 is beneficial for storing some of the energy expended when arch region 230 begins flattening upon impacting the ground, much like a coiling spring, and using it to lessen the energy demand for the following step. This makes walking, running, standing and the like more economical actions. If this level of support is not attainable because of the curvature of the medial portion of the foot, an arch support assemblage affords twofold relief: firstly by lowering the energy demands associated with standing or moving, and secondly by reinforcing proper curvature of arch region 230, thereby assisting arch region 230 in reusing energy expended in flattening the arch for impact with the ground.

As a result of the lowered energy demand for erect posture and movement, an arch support assemblage is also useful for persons with normal foot arches. While foot maladies are more likely to occur among those with structural difficulties or deficiencies in the foot or leg, they also occur in persons with no such difficulties or deficiencies, for example when beginning a more rigorous exercise regimen or running long distances on pavement or concrete. Furthermore, such difficulties as flat feet, elaborated upon in the discussion of FIG. 3(*b*), often develop gradually from slow wear and tear of the tendons, muscles, ligaments, and bones, or as a result of some medical conditions, such as diabetes, or diseases of the nervous system or muscular system, such as cerebral palsy or muscular dystrophy. Lastly, flat feet are known to temporarily develop in some pregnant women. In these instances, among many others, the sock disclosed in FIGS. 4-8, because of its stiff, yet comfortable nature, may help slow the onset of flat feet or, depending on the cause and circumstance, prevent flat feet altogether.

FIG. 3(*b*) is a side view of a foot with an insufficient amount of medial foot matter not in contact with the ground, thus forming a flat arch. Flat arch 334 is also commonly referred to as a fallen arch or as flat feet, and can result in a myriad of complications which may disrupt a sufferer's daily routine. For example, flat arch 334 may result in undue strain being put on calcaneus 112, heel 332, or on medial ball 222 and lateral ball 220 of foot 100. As a result of the discomfort or pain, a person may slowly alter their gait, often unknowingly, culminating then in undue stress being put on other parts of the body associated with standing, walking, or running, such as the back, Achilles tendon, toes, tibia 104, and shins. Frequently, this can lead to a number of subsequent injuries and general complications, typically soreness, inflammation, tendinitis, and fatigue, but also more directed complications such as painful shin splints or heel spurs.

Sock 436 disclosed in FIGS. 4-8, because of its stiff, yet comfortable nature, could not only help to alleviate a number of the abovementioned symptoms of flat arch 334, but also address the conformation of the foot which firstly manifests these symptoms.

Still referring to FIG. 3(*b*), flat arch 334 may decrease the functionality of the plantar fascia. The plantar fascia is an important set of thick, connective tissue, running from calcaneus 112 through metatarsals 116, which acts like a shock absorber, whereby it supports arch region 230 of foot 100 and makes manageable the immense stress and tension put on arch region 230 by the rest of the body. Upon decreasing the functionality of the plantar fascia, this tension may become too great, leading to small tears being made in the fascia, eventually resulting, in many instances, in inflammation and irritation, known as plantar fasciitis. Plantar fasciitis can cause severe pain in the heel and sole of the foot when in any foot-reliant erect posture, whether mobile or stationary, and is thus quite common in vocations such as athletics or military service. Sock 436 disclosed in FIGS. 4-8, because of its stiff, yet comfortable nature, could relieve much strain on the plantar fascia and more generally arch region 230, by delegating some of the bodily stress and pressure to the discussed arch-supporting sock 436. Thus, the described invention is useful as a treatment for plantar fasciitis or other inflammatory responses associated with insufficient support of the arch, greater foot area, or leg.

Figure 4A:
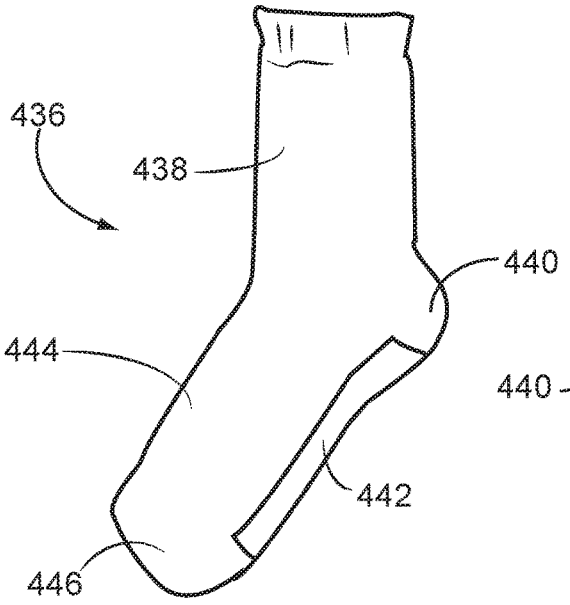
FIG. 4(*a*) is a side view of a right ankle-length sock, in accordance with one embodiment of the present invention.
Figure 4B:
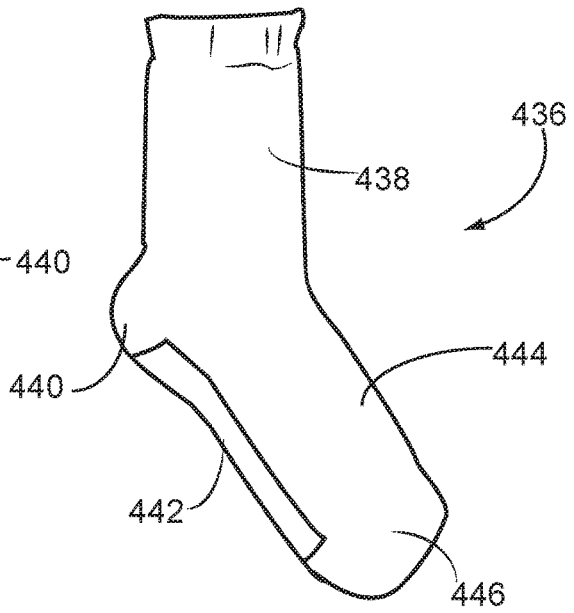

Each of the following figures describes the various parts, features, designs, and purposes of the proposed arch-supporting sock. FIG. 4(*a*) is a side view of a right ankle-length sock. Ankle-length sock 436 generally has the top of sock 436 reaching just above the ankle bone, also referred to as talus 106. Sock 436 displayed in FIG. 4(*a*) or in any other figure presents only one of many possible variations of sock designs and lengths and should not be seen as limiting or exhaustive. In this figure, sock 436 has sock leg 438, which describes the region from the opening of sock 436 until approximately the beginning of heel flap 440 in the back and instep 444 in the front. Heel flap 440 roughly encompasses heel 112 of foot 100, including the heel bone, also referred to as calcaneus 112, and can vary in weave density depending on a number of factors, such as but not limited to: sock length, style, or material.

The sock material is an important feature of the invention. The stiff, reinforcing region of the arch is not specific to a particular type of sock, and as such, can be made for any occasion, formal or informal, athletic, or otherwise. For instance, the sock may be made for the purposes of walking, running, skiing, snowboarding, working, hiking, or backpacking, though the enumerated purposes are by no means exhaustive. As a result of the various purposes wherein a person might find the invention of use, the sock can also comprise a myriad of materials. By way of just a few non-limiting examples, wool, polyester, cotton, acrylic, nylon, and cashmere may be utilized.

Sock instep 444 refers to the top region of sock 436 which overlays arch region 230 and arch support assemblage 442 but is not in contact with support assemblage 442 when foot 100 is inside sock 436. Arch support assemblage 442 rests in front of heel flap 440 and behind sock toe 446 and comprises a denser weave than the remaining regions of sock 436, although it does not employ the oft-used terry loops, as the terry loop weave is much better fit for cushioning than providing structural support and stability. Rather, in one non-limiting embodiment, arch support assemblage 442 may employ tuck stitching to achieve a denser weave in which a given sock segment may have multiple rows of stitching overlain. The proposed arch-supporting sock may employ terry loops elsewhere in the sock, where perhaps support and stability are not the goal. Accordingly, arch support assemblage 442 is stiffer than any other part of the sock, though stiffness may vary within arch support assemblage 442 due to differences in strain between parts of the arch. The arch or arch region 230, unless specified as a particular arch, such as transverse arch 224, is to be construed as the region falling on or within the confines of medial longitudinal arch 228, lateral longitudinal arch 226, and transverse arch 224.

Additionally, with reference to sock 436 of FIG. 4(*a*), arch support assemblage 442 is located on the right side of sock 436 to support arch region 230 of the foot, which endures the most stress on the inner portion of the midfoot. Arch support assemblage 442 transitions into sock toe 446, which covers the toes of the foot.

FIG. 4(*b*) is a side view of a right ankle-length sock. Sock 436 of FIG. 4(*b*) is substantially identical to that of FIG. 4(*a*) with the exception that the arch support assemblage 442 is on the left side of sock 436 to reflect the mirrored anatomy between the left and right feet.

Figure 5A:
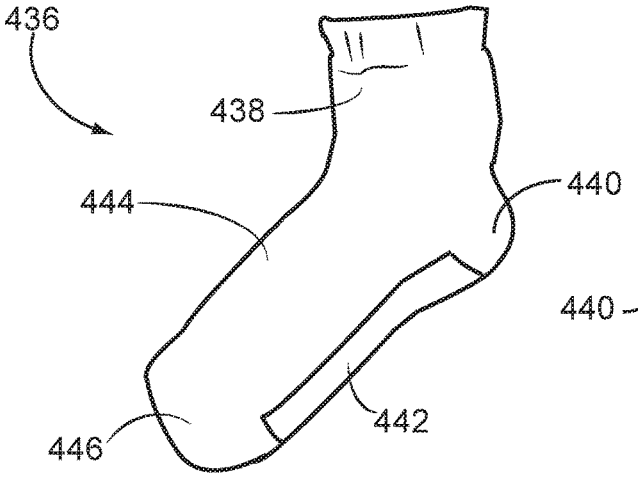
FIG. 5(*a*) is a side view of a right liner-length sock, in accordance with one embodiment of the present invention.
Figure 5B:
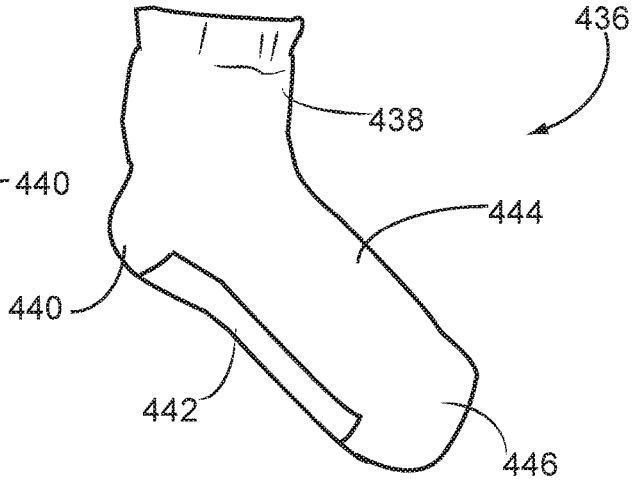

FIG. 5(*a*) is a side view of a left liner-length sock. A liner length sock 436 generally has the top of sock 436 reaching just below talus 106. In such an embodiment, sock 436, sock leg 438 is largely absent, quickly transitioning from the top of sock 436 into heel flap 440. Heel flap 440 extends to arch support assemblage 442, which itself extends to sock toe 446 roughly parallel to sock instep 444. Generally, a liner-length sock is used for athletics or walking, but is not restricted to doing so.

FIG. 5(*b*) is a side elevation view of a right liner-length sock. Sock 436 of FIG. 4 is substantially identical to that of FIG. 3 with the exception that arch support assemblage 442 is on the left side of sock 436 to reflect the mirrored anatomy between the left and right feet.

Figure 6:
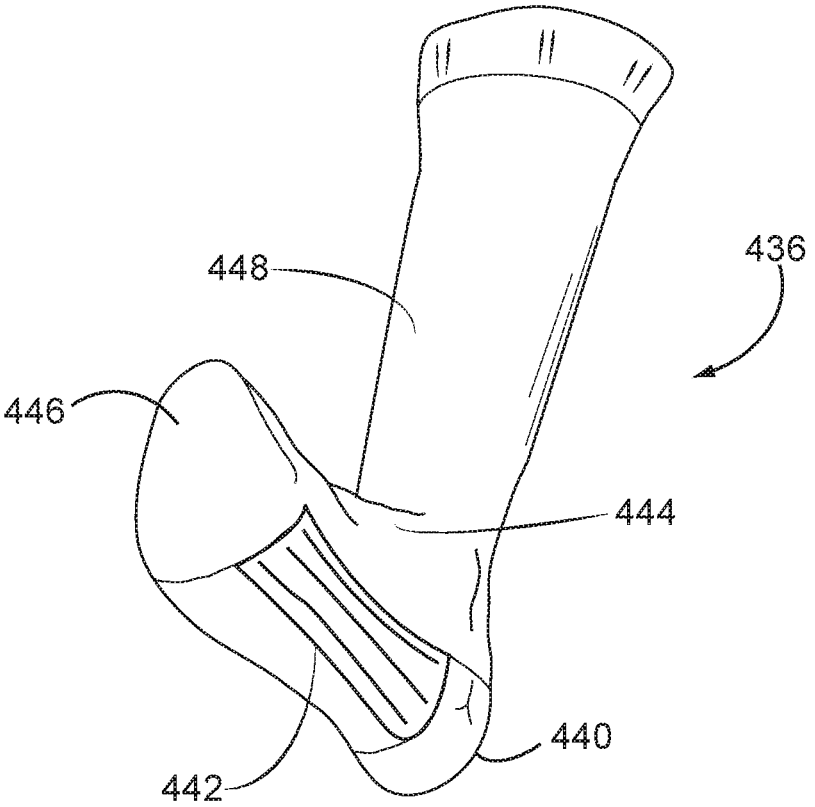
FIG. 6 is a perspective view of a right one-half knee-length sock, in accordance with one embodiment of the present invention.

FIG. 6 is a side perspective view of a one half hose-length sock. This figure better displays a sock that a user might wear in more formal circumstances or engagements, often but not exclusively work or work-related activities. By way of a non-limiting example, sock 436 may be comprised of polyester, cashmere, or nylon, especially if used as a formal or dress sock. In accordance with the present invention, this embodiment also comprises an arch support structure, namely, support assemblage 442.

Figure 7:
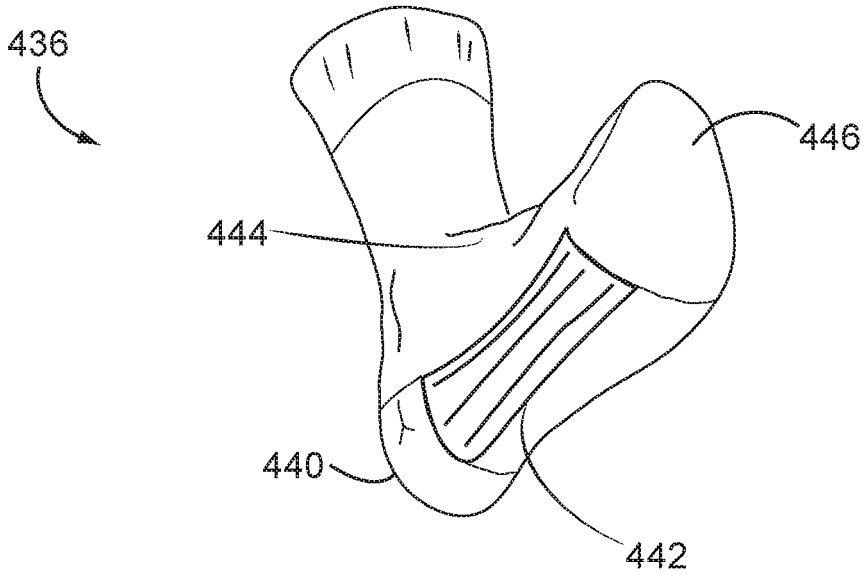
FIG. 7 is a side view of a left one-fourth knee-length sock, in accordance with one embodiment of the present invention.

FIG. 7 is a side perspective view of a one fourth hose-length sock in accordance with another embodiment of the present invention. This figure better displays a sock that a user might wear during such activities as hiking. Though not a requirement, a sock of this length will often be thicker than those of ankle, liner, or one-half length socks to provide increased insulation and protection from dampness seeping through the layers of the sock.

Figure 8:
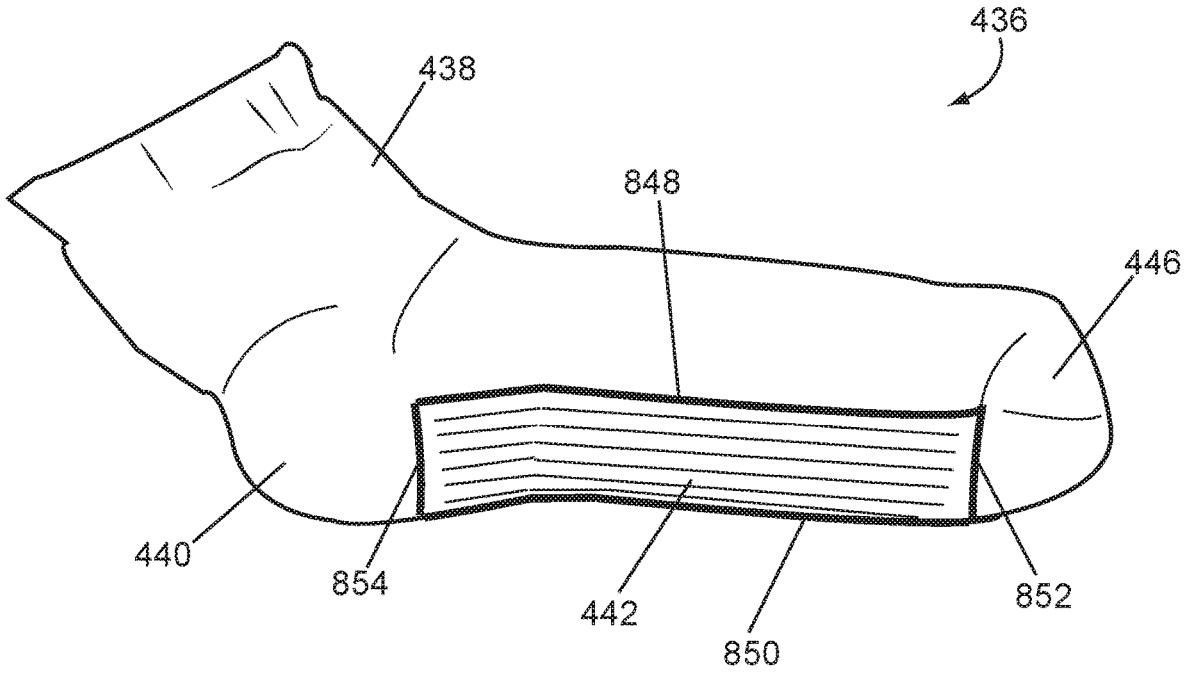
FIG. 8 depicts one embodiment of the arch support assemblage of a sock in accordance with the present invention.

FIG. 8 depicts one embodiment of the arch support assemblage in a left sock. In the pictured embodiment, arch support assemblage 442 is in the shape of a rectangle, though different shapes may exist in other embodiments without deviating from the spirit or scope of the present invention. The discussed embodiment has arch support assemblage 442 with longer sides running roughly parallel to the length of sock 436 either from heel flap 440 to sock toe 446 or vice versa, and shorter sides running perpendicular to the longer sides, the longer and shorter sides together forming a boundary perimeter between the archetypical sock features and arch support assemblage 442. The archetypical sock features are meant to be construed as those features outside of arch support assemblage 442 very frequently found in basic socks, such as heel flap 440, sock leg 438, and sock toe 446, as well as other features deemed standard or very common by those skilled in the art. Among the longer sides of arch support assemblage 442, a second perimetric boundary or medial longitudinal support 848 lies superior to a first perimetric boundary or lateral longitudinal support 850. In exemplary embodiments, medial longitudinal support 848 roughly extends along medial longitudinal arch 228. Also in exemplary embodiments, lateral longitudinal support 850 roughly extends along lateral longitudinal arch 226, at least to the extent that lateral longitudinal arch 226 is noticeably supported by lateral longitudinal support 850.

Among the shorter sides of arch support assemblage 442, with sock toe 446 considered to be the distal-most region and sock leg 438 considered the proximal-most region, a third perimetric boundary or transverse support 852 lies distal to a fourth perimetric boundary or heel support 854. In exemplary embodiments, transverse support 852 roughly extends along transverse arch 224, though other embodiments exist in which transverse support 852 is distal to transverse arch 224 and may more closely outline the boundary between the metatarsals and phalanges. Also in exemplary embodiments, heel support 854 roughly contours the distal end of heel 332 in the approximate region where the midfoot begins and hindfoot ends. Without deviating from the spirit or scope of the present invention, heel support 854 may also begin near the center of heel 332, with reference the length and not the width of sock 436. In the embodiment pictured in FIG. 8, as well as many other exemplary embodiments, the perimetric boundaries or supports that form arch support assemblage 442 are of varying elasticity coefficients.

In the present disclosure, elasticity coefficient generally refers to the ratio of acutely endured stress to the temporary change in conformation of an elastic entity, whereby for example, an entity with a low elasticity coefficient would be less flexible, pliable, or otherwise physically influenced than an entity with a high elasticity coefficient, assuming equal stress is applied.

The illustrated embodiment comprises medial longitudinal support 848, lateral longitudinal support 850, and transverse support 852 with lower elasticity coefficients than both heel support 854 and most or the rest of arch support assemblage 442 bound within the perimetric supports 848, 850, 852, 854. Parts of the arch-supporting sock having comparably lower elasticity coefficients will be more stiff and obdurate, that is resistant to physical manipulation or persuasion, and resultantly more stable and supportive of the corresponding regions of the foot resting upon these sock regions than will those parts with comparably higher elasticity coefficients. Accordingly, in these embodiments, the arch-supporting sock is able to stabilize and support the entirety of arch region 230, also referred to as the arch, as defined roughly by the dashed lines in FIG. 2, but provide even greater structural support and stability along the perimetric support boundaries where pressure is likely to be highest.

The difference of elasticity around and within the perimetric boundary of arch support assemblage 442 may be achieved in any number of ways. For example, and without limiting the scope of the present invention, arch support assemblage 442 is bound within the perimetric boundaries or perimetric supports 848, 850, 852, 854 and may comprise different knitting or stitching techniques known in the art, such as tuck-stitching, implemented in a manner so that arch support assemblage 442 comprises an increased weight, width, or thickness.

Other embodiments may comprise of perimetric supports which have elasticity coefficients less than most or the rest of sock 436. For instance, in one embodiment, the supports with the lowest elasticity coefficients are medial longitudinal support 848 and lateral longitudinal support 850, with transverse support 852 and heel support 854 registering elasticity coefficients roughly equal to that of the rest of arch support assemblage 442. Still other embodiments may, for example, provide the lowest elasticity coefficient levels around the entire perimeter of arch support assemblage 442, which comprises medial longitudinal support 848, lateral longitudinal support 850, transverse support 852, and heel support 854.

In one embodiment, only medial longitudinal support 848 will have a lower elasticity coefficient than each other part of the sock to account for the expectation that medial longitudinal support 848 will endure the greatest pressure while the user displays an erect posture.

In another embodiment, the perimetric supports may consist of varying elasticity coefficients generally based either on typical pressure expectations of the three arches and the distal heel region, or on the specific needs of persons with such aforementioned maladies as plantar fasciitis or a flat arch, among other maladies that would be known by those skilled in the art.

FIG. 8 depicts one embodiment of the arch support assemblage of a sock in accordance with the present invention. Hence, the support structure may be placed inside or on the outside of the sock without deviating from the scope of the present invention. Moreover, exemplary embodiments exist which do not require the exterior sock supports to have the same elasticity coefficients as their overlaid interior sock support counterparts. Instead, the interior supports may differ in elasticity coefficient from each other and from the supports of the exterior sock supports, though they need not differ for the proposed arch-supporting sock to be efficacious.

Figure 9:
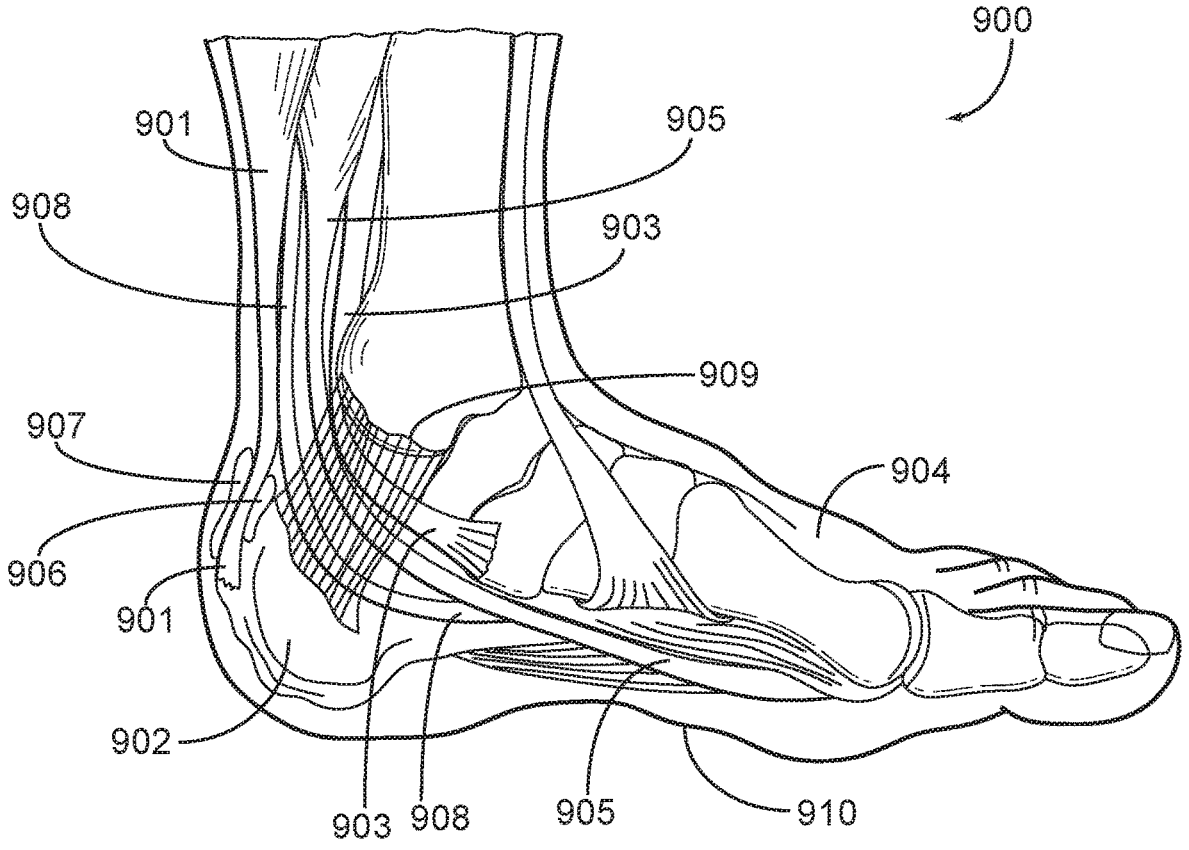
FIG. 9 is a diagram of a human foot depicting various tendons therein.

Turning now to FIG. 9, a diagram of a human foot depicting various tendons therein is illustrated as a reference to the physical features, namely the tendons and structures, that comprise the human foot, in order to provide greater context and understanding to the scope and purpose of the present invention—and in order to show additional regions outside of the arch of the foot that benefit from structural support by restricting movement of a particular area of the foot.

FIG. 9 specifically shows a diagram of a human foot 900, including the Achilles tendon 901, which is the large tendon that attaches the calf muscles to the back of the heel, or more specifically to the calcaneus 902 of foot 900. Achilles tendon 901 serves to attach the plantaris, gastrocnemius (calf) and soleus muscles to calcaneus 902. Achilles tendonitis is characterized by pain that is located 1 to 4 inches above the area where the tendon attaches to the heel bone. This is the weakest part of the tendon and is usually the spot where tendon tears occur. Achilles tendinitis is a common repetitive stress sports injury and can be brought on by any increase in activity or changes in shoes or terrain. Proper support in accordance with the present invention aids in preventing or minimizing stress that may cause such ailment.

The posterior tibialis tendon 903, the tendon of the tibialis posterior muscle, wraps around the inside of the ankle (medial malleolus) and instep 904 of the foot. That area is the usual site of pain and swelling associated with posterior tibial tendonitis (inner side of the ankle), which may be typically associated with flat feet. Conversely, peroneal tendonitis is inflammation of the peroneal tendons (not shown in this view) which run behind the lateral malleolus or the bony bit on the outside of the ankle (the other side of foot 900) causing and swelling on the outer ankle.

The flexor digitorum longus tendon 905 serves the flexor digitorum longus muscle, which extends from the back surface of the tibia to the foot. Flexor digitorum longus tendon 905 passes along the plantar surface of the foot. There, it divides into four parts that attach to the terminal bones of the four small toes. Flexor digitorum longus tendon 905 assists in plantar flexion of the foot, flexion of the four small toes, and inversion of the foot. A common ailment to this part of the foot is flexor tendonitis, which has characteristic pain deep in the back of the ankle.

Yet another common ailment of the foot is retrocalcaneal bursitis, which is an inflammation of the retrocalcaneal bursa 906 located between the calcaneus 902 and the anterior surface of the Achilles tendon 901. Retrocalcaneal bursitis commonly occurs in association with rheumatoid arthritis, spondyloarthropathies, gout, and trauma to this region of the foot.

Similarly, the retroachilles bursa 907, the bursa located between the Achilles tendon 901 and skin at the back of the heel, is also susceptible to inflammation. As such, retroachilles bursitis is a similar inflammation, but of the retroachilles bursa 907, typically associated with shoes that dig into the back of the heel. Retroachilles and retrocalcaneal bursitis can occur at the same time, which can make the pain and inflammation more difficult to treat. The pain is usually on the back of the heel and as such swelling may appear on lateral or medial side of Achilles tendon 901 with respect to foot 900.

The flexor hallucis longus tendon 908 passes downwards, deep through the flexor retinaculum 909, crossing the posterior ankle joint, lateral to flexor digitorum longus tendon 905. Flexor hallucis longus tendon 908 wraps around the lower end of the of the tibia, the back of the talus, and the inferior surface of the sustentaculum tali, where its passes through a fibrous, synovial-lined tunnel.

Flexor retinaculum 909 is a strong fibrous band, extending from the bony ankle prominence (malleolus) above, to the margin of the heel bone or calcaneus 902 below, forming a series of canals for the passage of tendons 903, 905, and 908 of the flexor muscles and the posterior tibial vessels and tibial nerve into the sole 910 of foot 900.

In order to prevent injuries and or minimize some of the ailments mentioned above, a proper support behind the foot, along a length of the Achilles tendon, and or a proper lateral support of the ankle (on both sides) may be implemented. For example, and without limiting the scope of the present invention, a sock in accordance with the present invention may provide support to minimize conditions such as injuries and or symptoms associated with tendonitis of the foot typically caused from overuse, abnormal foot structure, trauma or other medical conditions. Overuse may result from overly stretching during increased activity such as prolonged walking or participating in competitive sports. Problems such as flat feet or high arches can create muscular imbalances that put stress on one or more tendons. A foot or ankle injury can also cause tendonitis; typically due to sudden, powerful motions like jumping or from chronic rubbing against a show—for example at the heel—resulting in tendonitis in the inflicted area. Of course, other medical conditions that cause inflammation can also lead to tendonitis, such as rheumatoid arthritis, gout, and spondyloarthropathy, which can cause Achilles tendonitis or posterior tibial tendonitis.

Accordingly, in order to prevent injuries and or minimize some of the ailments mentioned above, a proper support behind the foot along a length of the Achilles tendon and or a proper support of the ankle may be implemented in accordance with the present invention.

Figure 10A:
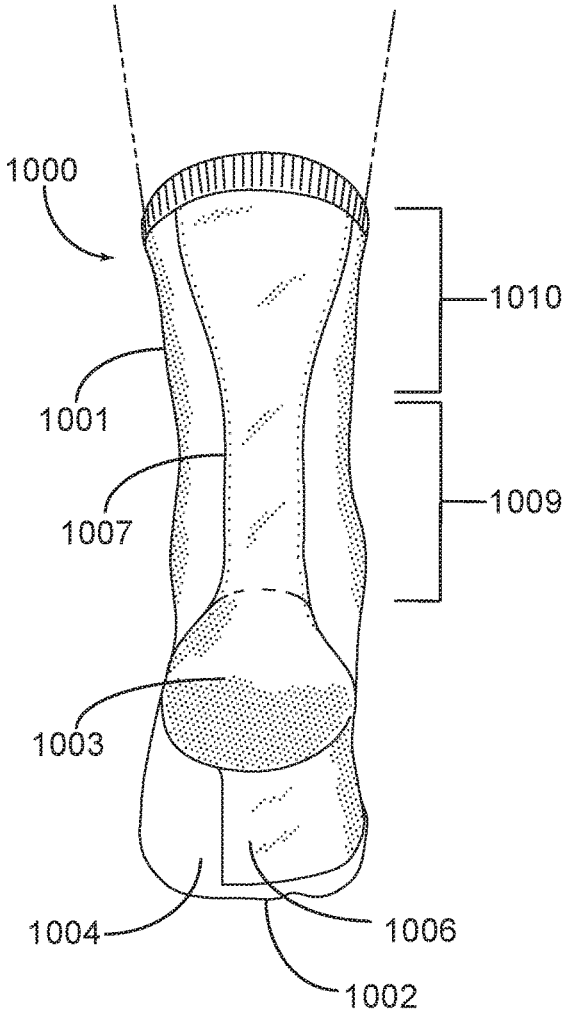
FIG. 10(*a*) is a back view of a sock in accordance with an exemplary embodiment of the present invention.
Figure 10B:
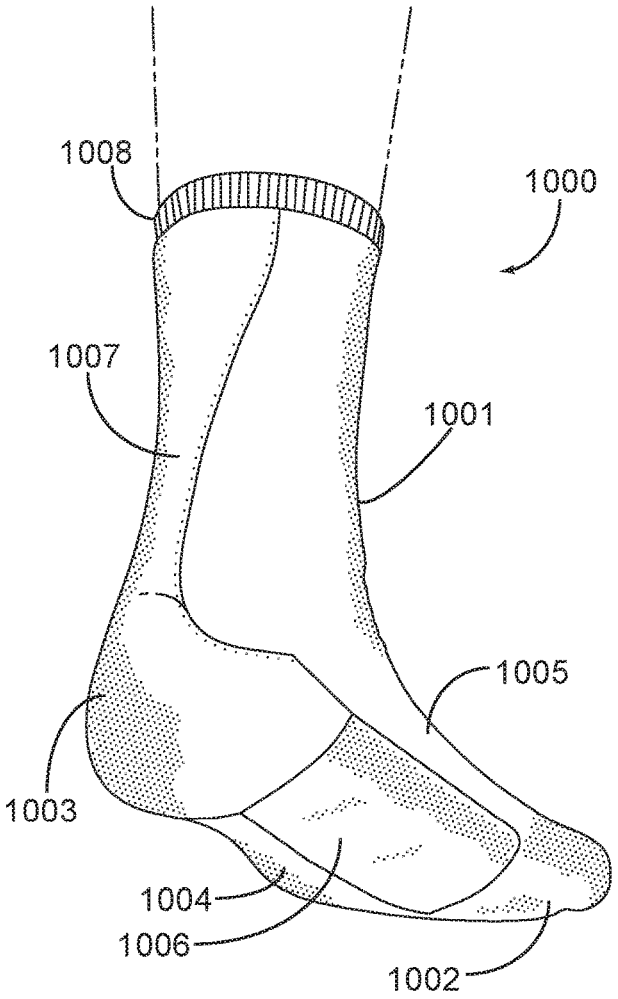
Figure 10C:
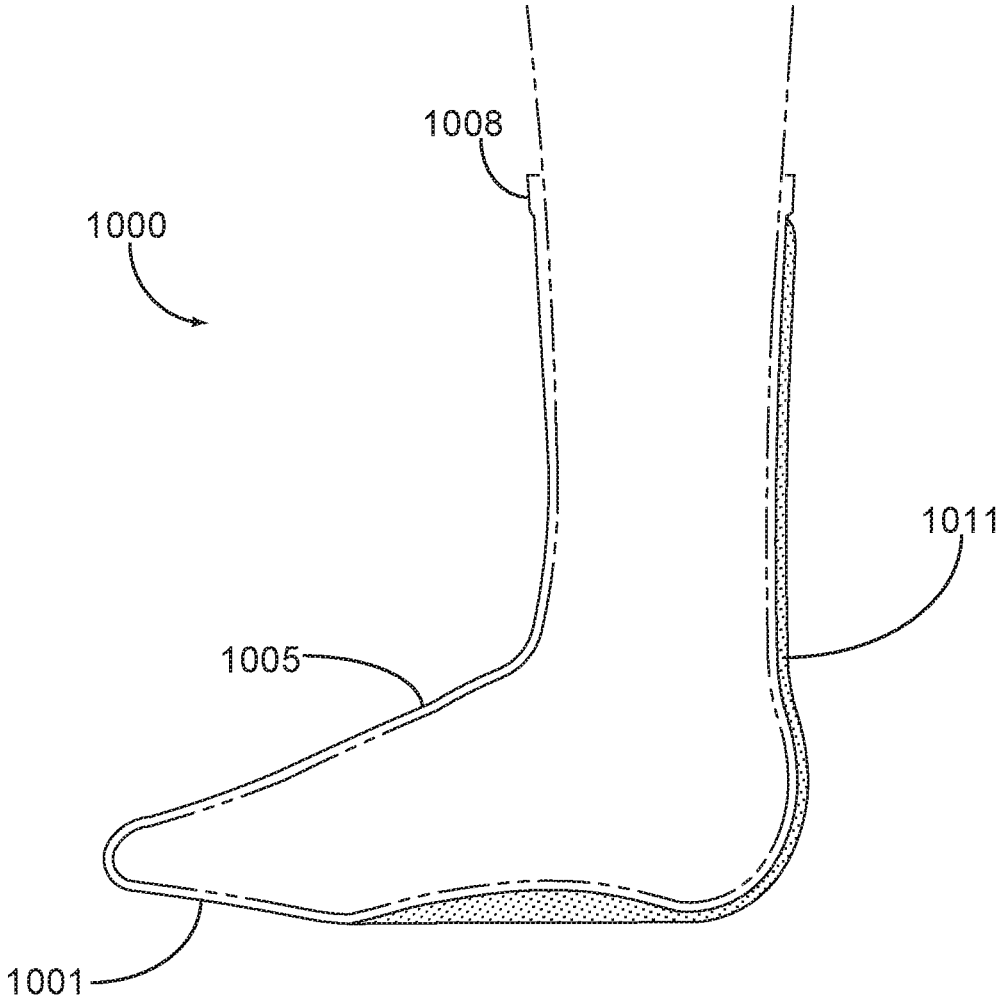

Turning to the next set of figures, FIG. 10(*a*) is a back view of a sock in accordance with an exemplary embodiment of the present invention; FIG. 10(*b*) is a perspective side view thereof; and FIG. 10(*c*) is a cross-sectional side view of the sock in FIGS. 10(*a*)-10(*b*). More specifically, FIGS. 10(*a*)-10(*c*) depict sock 1000, comprising a sock body 1001 defined by a toe section 1002, a heel flap 1003, a sole 1004 extending between toe section 1002 and heel flap 1003 on a bottom portion of sock 1000, and an instep 1005 extending between the toe section 1002 and the heel flap 1003 on a top portion of sock 1000. Furthermore, sock 1000 also comprises an arch support assemblage 1006, adapted to cover an arch region of the sole 1004 of the sock 1000 excluding the toe section 1002 of the sock 1000.

In some exemplary embodiments, such as the one depicted in FIG. 10(*a*), the toe section 1002 and instep 1005 have a first elasticity coefficient, and arch support assemblage 1006, adapted to cover an arch region of the sole 1004 of the sock 1000 excluding the toe section 1002 of the sock 1000, has a second elasticity coefficient, wherein the second elasticity coefficient is lower than the first elasticity coefficient. In some exemplary embodiments, the portion of sole 1004 of sock 1000 that is not covered by arch support assemblage 1006 comprises the first elasticity coefficient since these sections are typically formed of the same material—for example, and without limiting the scope of the present invention, using the same number of terry loops throughout.

Furthermore, sock 1000 also comprises an Achilles support assemblage 1007, adapted to cover a portion of an Achilles tendon of a wearer of the sock 1000. In some exemplary embodiments, such as the one depicted in FIG. 10(*a*), Achilles support assemblage 1007 runs from a top edge of the heel flap 1003 to a top portion of a leg of sock body 1001 of sock 1000, terminating at an edge between the leg of sock body 1001 and cuff 1008.

In some exemplary embodiments, Achilles support assemblage 1007 comprises a narrow band situated along a posterior region of the leg of sock body 1001 that lays adjacent and is adapted to cover a portion of the Achilles tendon of the wearer, wherein the narrow band includes a first region 1009 that is narrow and extends upwards from a distal end of heel flap 1003 towards cuff 1008 along a center posterior portion of the leg of sock body 1001, and a second region 1010 that widens as Achilles support assemblage 1007 reaches a distal edge of cuff 1008.

In some exemplary embodiments, Achilles support assemblage 1007 has an elasticity coefficient that is lower than the elasticity coefficient of the sock body 1001. In some exemplary embodiments, Achilles support assemblage 1007 has an elasticity coefficient that is equal to the elasticity coefficient of the arch support assemblage 1006. In some exemplary embodiments, Achilles support assemblage 1007 has an elasticity coefficient that is lower than the elasticity coefficient of the sock body 1001, but not necessarily equal to an elasticity coefficient of arch support assemblage 1006. In some exemplary embodiments, Achilles support assemblage 1007 has an elasticity coefficient that is equal to the elasticity coefficient of the heel flap 1003. In some exemplary embodiments, arch support assemblage 1006, Achilles support assemblage 1007, and heel flap 1003 have the same elasticity coefficient, and that elasticity coefficient is lower than an elasticity coefficient of sock body 1001 (i.e. which in some embodiments, this region of the sock with a higher elasticity coefficient includes toe section 1002, the leg of sock body 1001, and sole 1004).

In some exemplary embodiments, Achilles support assemblage 1007 and the heel flap 1003 of sock 1000 comprise an integral component adhered to sock body 1001 of sock 1000. In some exemplary embodiments, Achilles support assemblage 1007 is separately adhered or constructed into sock body 1001 as a first component, heel flap 1003 of sock 1000 is separately adhered or constructed into sock body 1001 as a second component, and arch support assemblage 1007 is separately adhered or constructed into sock body 1001 of sock 1000 as a third component.

Materials and construction of Achilles support assemblage 1007 may vary without deviating from the scope of the present invention. In some embodiments, Achilles support assemblage comprises a denser weave than the remaining regions of sock 1000, although it does not employ the oft-used terry loops, as the terry loop weave is much better fit for cushioning than providing structural support and stability. Rather, in one non-limiting embodiment, Achilles support assemblage 1007 may employ tuck stitching to achieve a denser weave in which a given sock segment may have multiple rows of stitching overlain. The sock 1000 may employ terry loops elsewhere in the sock, where perhaps support and stability are not the goal. Accordingly, Achilles support assemblage 1007 may be stiffer than other parts of the sock (including the arch support assemblage 1006). In some exemplary embodiments, components other than threaded materials that may be woven into sock 1000 may form the construction of Achilles support assemblage 1007. For example, and without limiting the scope of the present invention, padded materials, silicon, rubber or other materials may be used and or implemented with Achilles support assemblage 1007 in order to provide a desired stiffness.

In the cross-sectional view of FIG. 10(*c*), it may be appreciated that in some exemplary embodiments sock 1000 comprises a layer 1011 that comprises an elasticity coefficient that is lower than an elasticity coefficient of the remaining portion of sock body 1001. As mentioned above, the elasticity coefficient of layer 1011 is lower than an elastic coefficient of the remaining sock body 1001. This construction stiffens the affected regions of sock 1000 such that added support is provided to the foot. With respect to the arch support assemblage, the structural support aids the arch in a manner consistent with the disclosure above with reference to earlier figures. With respect to the Achilles support assemblage, the structural support aids by minimizing movement or decrease range in motion of the foot at the areas covered by the support assemblage. This helps prevents or minimizes injuries to associated with the Achilles tendon. Furthermore, the added support of Achilles support assemblage reduces helps prevents or minimizes injuries due to inflammation of the bursa 906 and 907.

Figure 11A:
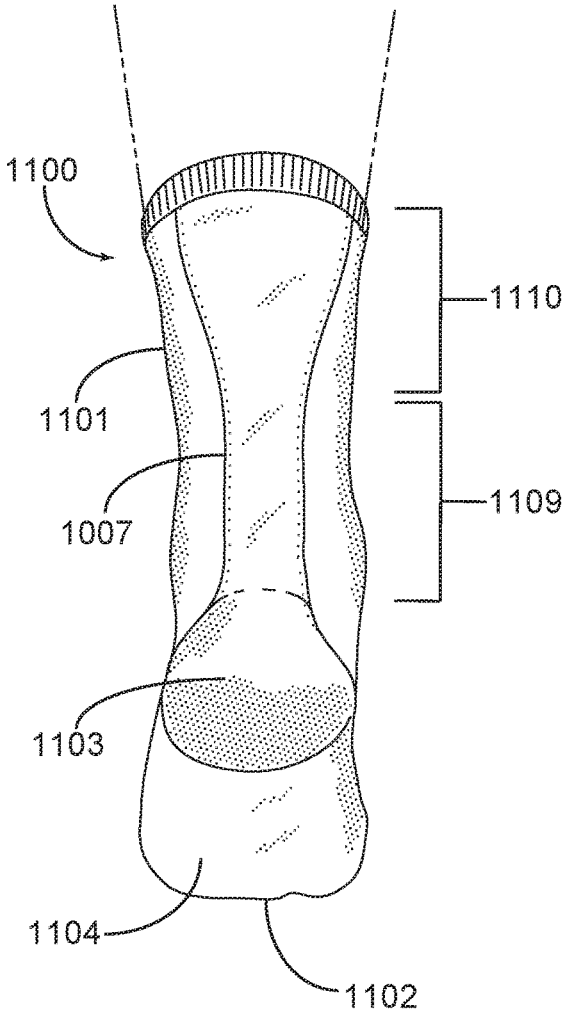
FIG. 11(*a*) is a back view of a sock in accordance with an exemplary embodiment of the present invention.
Figure 11B:
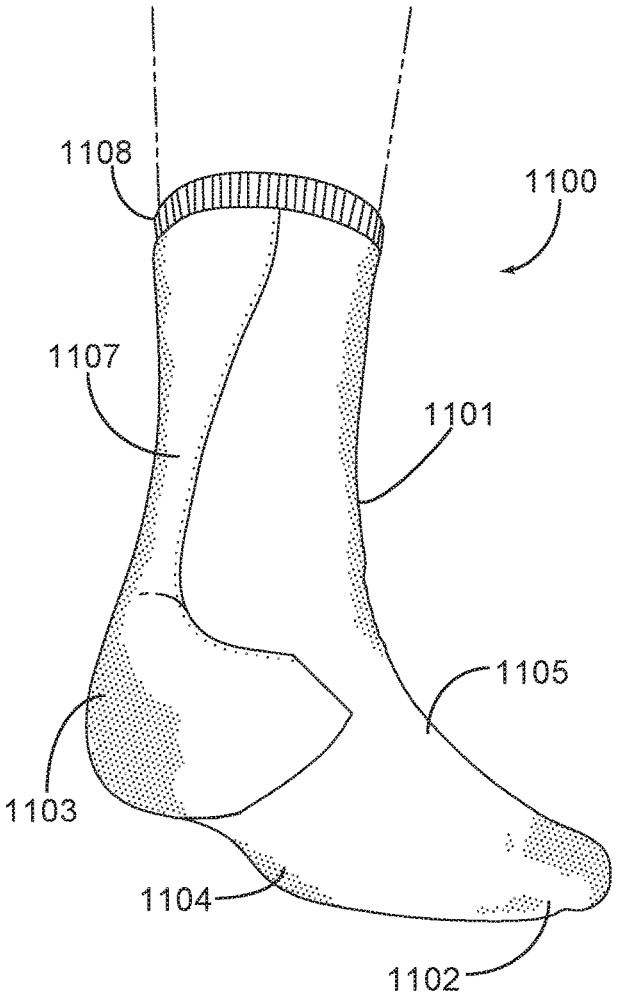
Figure 11C:
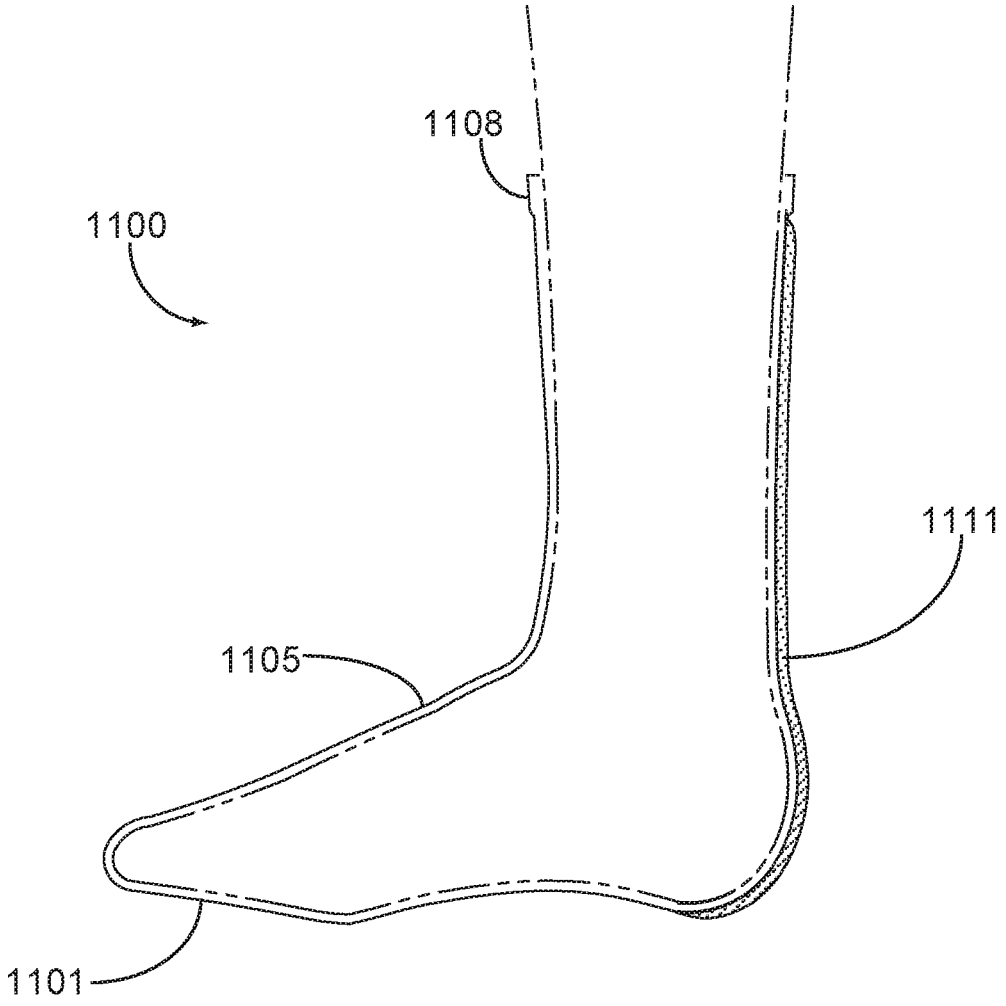

Turning to the next set of figures, FIG. 11(*a*) is a back view of a sock in accordance with an exemplary embodiment of the present invention; FIG. 11(*b*) is a perspective side view thereof; and FIG. 11(*c*) is a cross-sectional side view of the sock in FIGS. 11(*a*)-11(*b*). More specifically, FIGS. 11(*a*)-11(*c*) depict sock 1100, which is similar to sock 1000, with the notable exception that sock 1100 excludes an arch support assemblage at the sole of the sock.

Accordingly, in such exemplary embodiments in which an arch support assemblage is excluded, sock 1100 may comprise a sock body 1101 defined by a toe section 1102, a heel flap 1103, a sole 1104 extending between toe section 1102 and heel flap 1103 on a bottom portion of sock 1100, and an instep 1105 extending between the toe section 1102 and the heel flap 1103 on a top portion of sock 1100. As such, although sock 1100 excludes an arch support assemblage, sock 1100 comprises an Achilles support assemblage 1107.

In some exemplary embodiments, Achilles support assemblage 1107 comprises a narrow band situated along a posterior region of the leg of sock body 1101 that lays adjacent and is adapted to cover a portion of the Achilles tendon of the wearer, wherein the narrow band includes a first region 1109 that is narrow and extends upwards from a distal end of heel flap 1103 towards cuff 1108 along a center posterior portion of the leg of sock body 1101, and a second region 1110 that widens as Achilles support assemblage 1107 reaches a distal edge of cuff 1008. In some exemplary embodiments, Achilles support assemblage 1107 has an elasticity coefficient that is lower than the elasticity coefficient of the sock body 1101. In some exemplary embodiments, Achilles support assemblage 1107 has an elasticity coefficient that is equal to the elasticity coefficient of the heel flap 1103. In some exemplary embodiments, Achilles support assemblage 1107 and heel flap 1103 have the same elasticity coefficient, and that elasticity coefficient is lower than an elasticity coefficient of sock body 1101 (i.e. which in some embodiments, this region of the sock with a higher elasticity coefficient includes toe section 1102, the leg of sock body 1101, and sole 1104).

In some exemplary embodiments, Achilles support assemblage 1107 and the heel flap 1103 of sock 1100 comprise an integral component adhered to sock body 1101 of sock 1100. In some exemplary embodiments, Achilles support assemblage 1107 is separately adhered or constructed into sock body 1101 as a first component, and heel flap 1103 of sock 1000 is separately adhered or constructed into sock body 1101 as a second component. Moreover, as mentioned with regard to Materials and construction of Achilles support assemblage 1107, different materials and or manners of construction may be implemented in order to achieve a desired stiffness of Achilles support assemblage 1107.

In the cross-sectional view of FIG. 11(*c*), it may be appreciated that in some exemplary embodiments sock 1100 comprises a layer 1111 that comprises an elasticity coefficient that is lower than an elasticity coefficient of the remaining portion of sock body 1101. Notably, the extra support layer 1111 does not extend into the arch region of the sole of sock 11000 since this embodiment does not include an arch support assemblage. As mentioned above, this construction stiffens the affected regions of sock 1100 such that added support is provided to the foot.

Figure 12A:
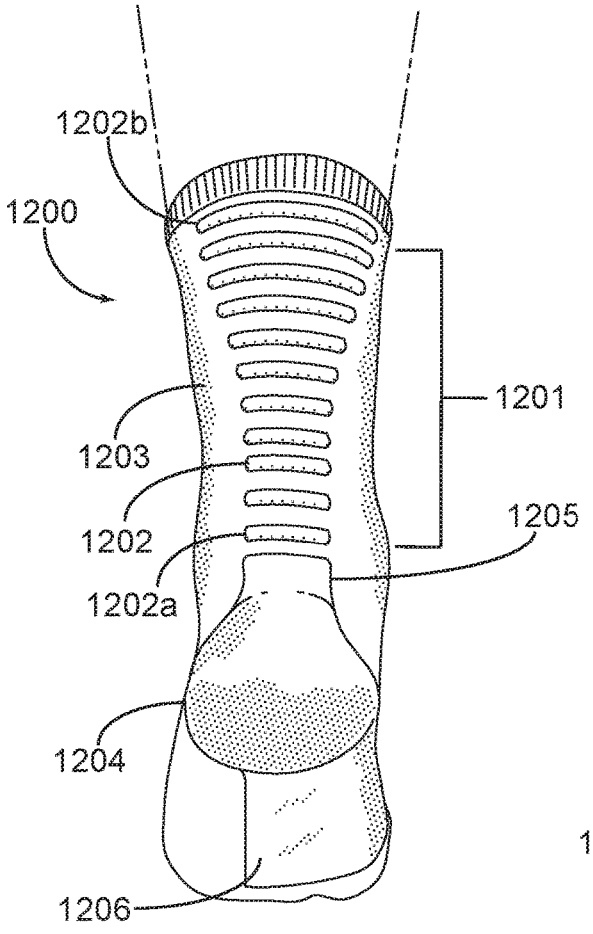
FIG. 12(*a*) is a back view of a sock in accordance with an exemplary embodiment of the present invention.
Figure 12B:
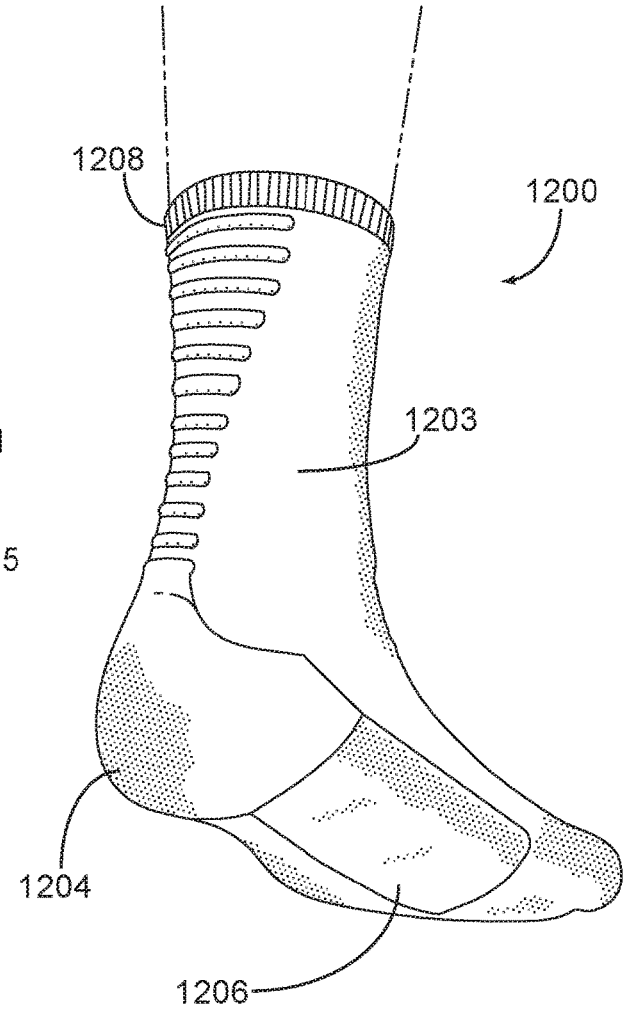
Figure 12C:
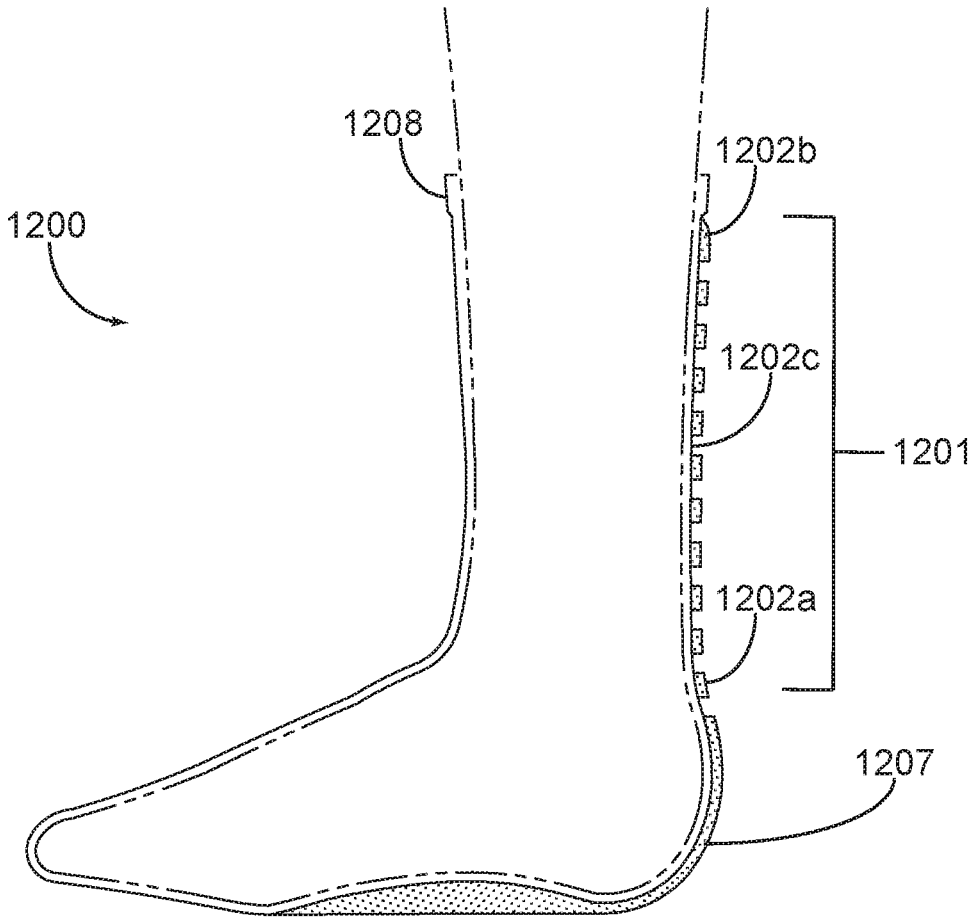

Turning now to the next set of figures, FIG. 12(*a*) is a back view of a sock in accordance with an exemplary embodiment of the present invention; FIG. 12(*b*) is a perspective side view thereof; and FIG. 12(*c*) is a cross-sectional side view of the sock in FIGS. 12(*a*)-12(*b*). More specifically, FIGS. 12(*a*)-12(*c*) depict sock 1200, which includes an Achilles support assemblage 1201 that is structured differently than Achilles support assemblages 1007 or 1107. In this embodiment, Achilles support assemblage 1201 comprises a plurality of lateral bands or strips 1202 aligned along a height of the leg 1203 of the sock 1200, each strip laying adjacent to a portion of the Achilles tendon and adapted to cover a portion of the Achilles tendon of the wearer, wherein the plurality of strips 1202 includes a first terminal end strip 1202*a* that is shorter in relation to a second terminal end strip 1202*b* situated at the top of sock leg 1203 near an edge of cuff 1208. Each of the strips 1202 of Achilles support assemblage 1201 are aligned and spaced apparat from a distal end of heel flap 1204 towards cuff 1208 along a center posterior portion of the leg 1203 of sock 1200, with each successive strip longer that the strip below so that the region covered by each strip widens as Achilles support assemblage 1201 reaches a distal edge of cuff 1208. In this embodiment, heel flap 1204 may include a heel flap lip 1205 that forms a part of the support provided by Achilles support assemblage 1201. As mentioned with regard to materials and construction of an Achilles support assemblage in accordance with other embodiments of the present invention, different materials and or manners of construction may be implemented in order to achieve a desired stiffness of Achilles support assemblage 1201.

In the embodiment depicted by FIGS. 12(*a*)-12(*c*) an arch support assemblage 1206 may be provided. In exemplary embodiments, arch support assemblage 1206 is similar to one of the various arch support assemblages described above with respect to previous embodiments, and as such is similarly adapted to cover an arch region of the sole of the sock 1200 excluding the toe section of sock 1200.

In the cross-sectional view of FIG. 12(*c*), it may be appreciated that in some exemplary embodiments sock 1200 comprises a support layer 1207 that includes an elasticity coefficient that is lower than an elasticity coefficient of the remaining portion of sock 1200. As mentioned above, the elasticity coefficient of layer 1207 is lower than an elastic coefficient of the remaining sock 1200. This construction stiffens the affected regions of sock 1200 such that added support is provided to the foot, as mentioned above. From this view a plurality of spaces 1202*c* may be appreciated laying in between each of the plurality of strips 1202 that form Achilles support assemblage 1201.

Figure 13A:
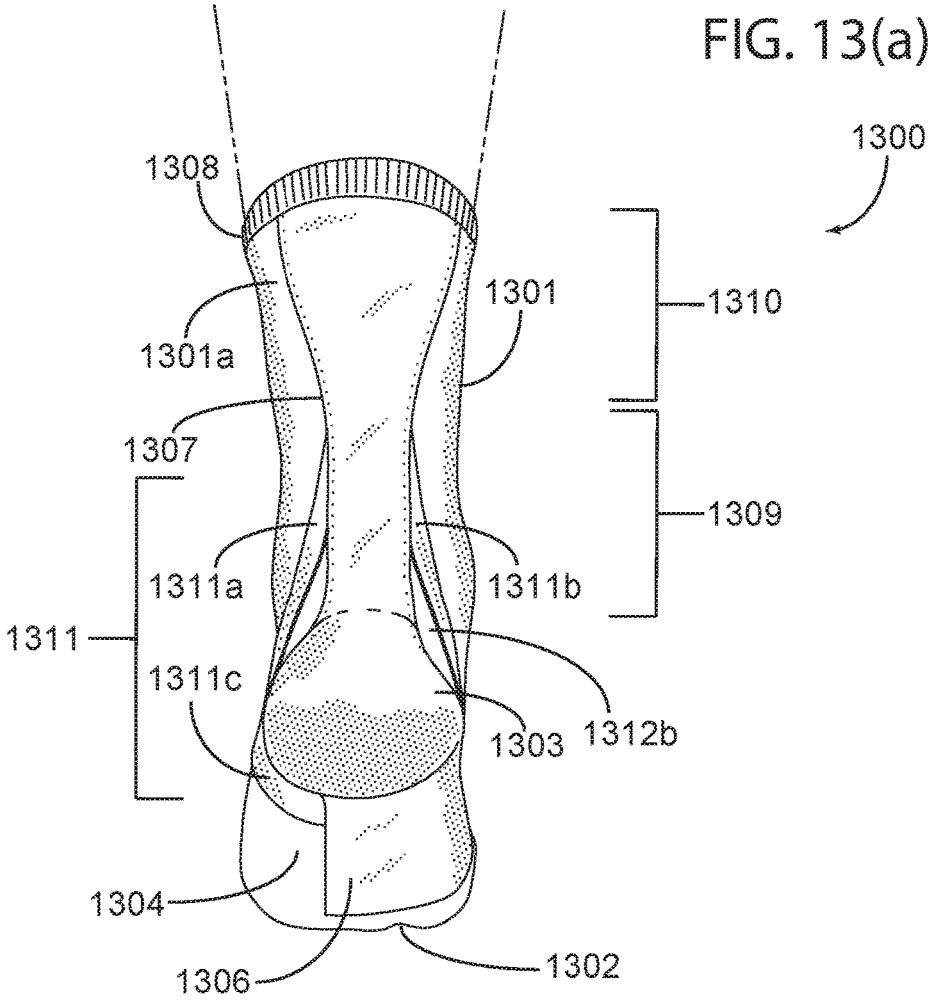
FIG. 13(*a*) is a back view of a sock in accordance with an exemplary embodiment of the present invention.
Figure 13B:
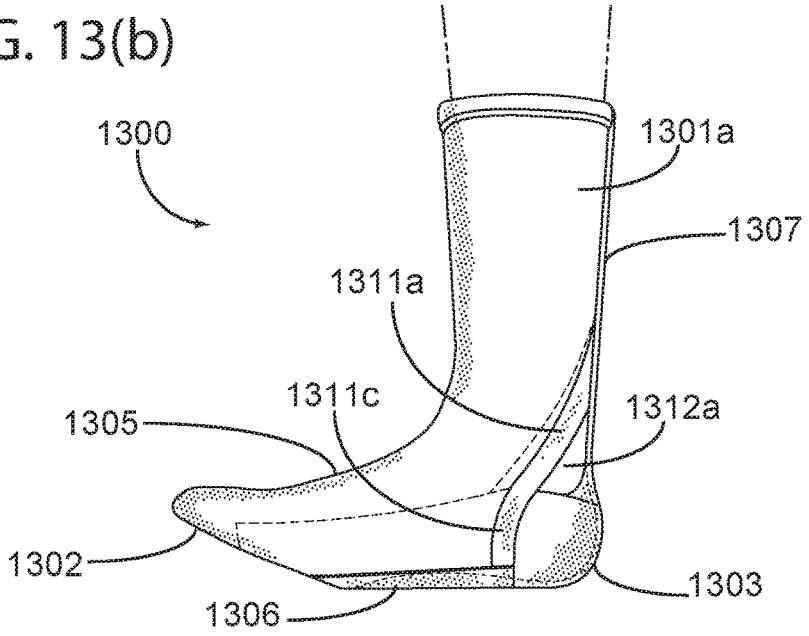
Figure 13C:
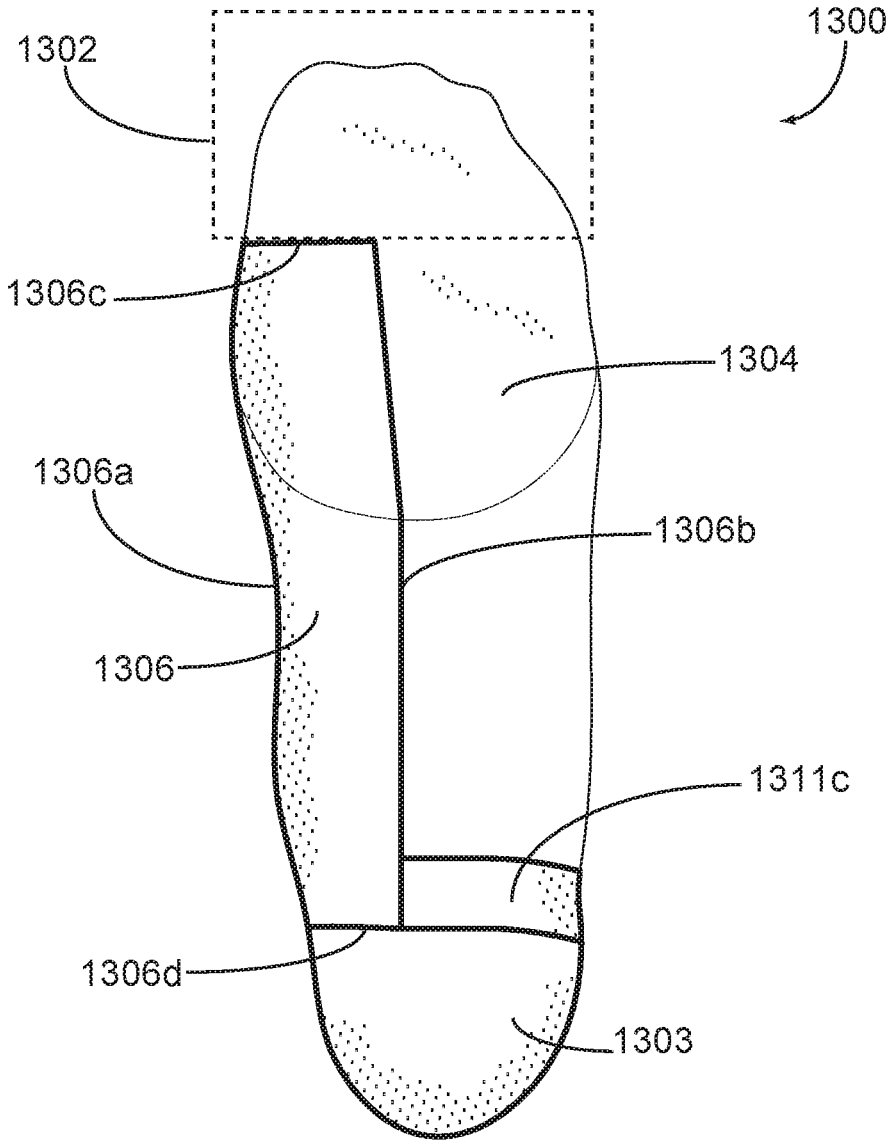

Turning to the next set of figures, FIG. 13(*a*) is a back view of a sock in accordance with an exemplary embodiment of the present invention; FIG. 13(*b*) is a side view thereof; and FIG. 13(*c*) is a bottom view of the sock in FIGS. 13(*a*)-13(*b*). More specifically, FIGS. 13(*a*)-13(*c*) depict sock 1300, which includes a sock body 1301 defined by a toe section 1302, a heel flap 1303, a sole 1304 extending between the toe section 1302 and the heel flap 1303 on a bottom portion of the sock 1300, and an instep 1305 extending between the toe section 1302 and the heel flap 1303 on a top portion of the sock, the toe section 1302 and instep 1305 having a first elasticity coefficient.

Moreover, sock 1300 includes an arch support assemblage 1306, adapted to cover an arch region of the sole 1304 of the sock 1300 excluding the toe section 1302 of the sock 1300 and in some embodiments as shown also excluding the heel flap 1303 of sock 1300 as well as the remainder of sole 1304, the arch support assemblage 1306 having a second elasticity coefficient, wherein the second elasticity coefficient is lower than the first elasticity coefficient such that this region of the sock comprises a stiffer more resilient structure.

Moreover, sock 1300 includes an Achilles support assemblage 1307. Achilles support assemblage 1307 is adapted to cover a portion of an Achilles tendon of a wearer of the sock 1300. In some exemplary embodiments, such as the one depicted in FIG. 13(*a*), Achilles support assemblage 1307 runs from a top edge of the heel flap 1303 to a top portion of leg 1301*a* of sock body 1301 of sock 1300, terminating at an edge between the leg of sock body 1301 and cuff 1308.

In some exemplary embodiments, Achilles support assemblage 1307 comprises a narrow band situated along a posterior region of the leg of sock body 1301 that lays adjacent and is adapted to cover a portion of the Achilles tendon of the wearer, wherein the narrow band includes a first region 1309 that is narrow and extends upwards from a distal end of heel flap 1303 towards cuff 1308 along a center posterior portion of the leg of sock body 1301, and a second region 1310 that widens as Achilles support assemblage 1307 reaches a distal edge of cuff 1308.

In some exemplary embodiments, Achilles support assemblage 1307 has an elasticity coefficient that is lower than the elasticity coefficient of the sock body 1301. In some exemplary embodiments, Achilles support assemblage 1307 has an elasticity coefficient that is equal to the elasticity coefficient of the arch support assemblage 1306. In some exemplary embodiments, Achilles support assemblage 1307 has an elasticity coefficient that is lower than the elasticity coefficient of the sock body 1301, but not necessarily equal to an elasticity coefficient of arch support assemblage 1306. In some exemplary embodiments, Achilles support assemblage 1307 has an elasticity coefficient that is equal to the elasticity coefficient of the heel flap 1303. In some exemplary embodiments, arch support assemblage 1306, Achilles support assemblage 1307, and heel flap 1303 have the same elasticity coefficient, and that elasticity coefficient is lower than an elasticity coefficient of sock body 1301 (i.e. which in some embodiments, this region of the sock with a higher elasticity coefficient includes toe section 1302, the leg of sock body 1301, and sole 1304).

In some exemplary embodiments, Achilles support assemblage 1306 and the heel flap 1303 of sock 1300 comprise an integral component adhered to sock body 1301 of sock 1300. In some exemplary embodiments, Achilles support assemblage 1306 is separately adhered or constructed into sock body 1301 as a first component, heel flap 1303 of sock 1300 is separately adhered or constructed into sock body 1301 as a second component, and arch support assemblage 1306 is separately adhered or constructed into sock body 1301 of sock 1300 as a third component.

Moreover, sock 1300 includes an ankle support assemblage 1311. Ankle support assemblage 1310 comprises a pair of bands or strips 1311*a* and 1311*b* extending from the Achilles support assemblage 1307 to distal end of the heel flap 1303 of the sock 1300, adapted to cover a portion of an ankle of the wearer of the sock. More specifically, a first strip 1311*a* may be a peroneal strip adapted to partially cover or run adjacent to an outer portion of the ankle of the wearer, or more specifically cover a portion of the peroneal tendons that run behind the lateral malleolus or the bony bit on the outside of the outer ankle. On the opposite side of sock 1300, a second strip 1311*b* may be a posterior tibial strip adapted to partially cover or run adjacent to an inner portion of the ankle of the wearer, or more specifically cover a portion of the posterior tibialis tendon that wraps around the inside of the ankle (medial malleolus) and instep of the foot of the wearer. In exemplary embodiments, each of peroneal strip 1311*a* and posterior tibial strip 1311*b* may have an elasticity coefficient that is lower than an elasticity coefficient of the remaining of the sock body 1301. As such, the portion of the sock body outside of strips 1311*a* and 1311*b*, including the spaces formed between each strip such as space 1312, will have a higher elasticity coefficient than each strip 1311*a* and 1311*b* since each strip comprises a denser or more rigid construction.

In exemplary embodiments, as shown in FIG. 13(*a*) and FIG. 13(*b*), ankle support assemblage 1311 further comprises a third strip or wrap 1311*c*, which may be a peroneal tendon wrap that wraps around the sole 1304 of the sock 1300 connecting with a posterior region of the arch support assemblage 1306. More specifically, wrap 1311*c* wraps along the outer side of the sock 1300 and underneath the wearer's heel such that the peroneal tendon wrap 1311*c* connects both the heel flap 1303 and the arch support assemblage 1306 with the Achilles support assemblage 1307.

In some exemplary embodiments, ankle support assemblage 1311 has an elasticity coefficient that is lower than the elasticity coefficient of the sock body 1301. In some exemplary embodiments, ankle support assemblage 1311 has an elasticity coefficient that is equal to the elasticity coefficient of the arch support assemblage 1306. In some exemplary embodiments, ankle support assemblage 1311 has an elasticity coefficient that is lower than the elasticity coefficient of the sock body 1301, but not necessarily equal to an elasticity coefficient of arch support assemblage 1306.

FIG. 13(*c*) is a bottom view of the sock in FIGS. 13(*a*)-13(*b*). From this view, it may be appreciated how the peroneal tendon wrap 1311*c* connects both the heel flap 1303 and the arch support assemblage 1306 with the Achilles support assemblage 1307. More specifically, the boundaries of the support assemblages (i.e. arch support assemblage 1306 and ankle support assemblage 1311) that divide the sole 1304 of sock 1300 into different regions are described with reference to this figure. That is, in accordance with some exemplary embodiments of the present invention, sole 1304 may include a first region that has a higher elasticity coefficient than a second region, wherein the second region includes the arch support assemblage 1306, peroneal tendon wrap 1311*c* of ankle support assemblage 1310, and heel flap 1302. In accordance with some exemplary embodiments of the present invention, sole 1304 may include a first region that has a higher elasticity coefficient than a second region, wherein the second region includes the arch support assemblage 1306 and peroneal tendon wrap 1311*c* of ankle support assemblage 1310, but excludes heel flap 1302 (i.e. heel flap 1303 may have in some exemplary embodiments an elasticity coefficient equal to that of the first region or sole 1304, or heel flap 1303 may have a lower elasticity coefficient than sole 1304 but nonetheless higher elasticity coefficient than the arch support assemblage 1306 and peroneal tendon wrap 1311*c* of ankle support assemblage 1310).

From this view, it may be appreciated that arch support assemblage 1306 may include a first perimetric boundary 1306*a* on an outer bottom portion of sole 1304 of sock 1300; a second perimetric boundary 1306*b* that runs roughly parallel to the first perimetric boundary 1306*a*; a third perimetric boundary 1306*c* that runs roughly perpendicular to the first and second perimetric boundaries and along a distal end of toe section 1302; and a fourth perimetric boundary 1306*d* that runs roughly perpendicular to the first and second perimetric boundaries and roughly parallel to the third perimetric boundary 1306*c* and along a distal end of heel flap 1303 touching a portion of peroneal tendon wrap 1311*c* of ankle support assemblage 1311.

Ankle support assemblage 1311 is almost entirely above the sole and thus not visible in FIG. 13(*c*) with the exception of peroneal tendon wrap 1311*c*, which together with perimetric boundary 1306*c* of arch support assemblage 1306 touch a distal end of heel flap 1303 situated at a bottom portion of sock 1300 along sole 1304.

Materials and construction of ankle support assemblage 1311 may vary without deviating from the scope of the present invention. In some embodiments, ankle support assemblage 1311 (including as mentioned above strips 1311*a*, 1311*b* and wrap 1311*c*) comprises a denser weave than the remaining regions of sock 1300, although it does not employ the oft-used terry loops, as the terry loop weave is much better fit for cushioning than providing structural support and stability.

In other exemplary embodiments, ankle support assemblage 1311 may employ tuck stitching to achieve a denser weave in which a given sock segment may have multiple rows of stitching overlain. The sock 1300 may employ terry loops elsewhere in the sock, where perhaps support and stability are not the goal. Accordingly, ankle support assemblage 1311 is typically stiffer than other parts of the sock. In some exemplary embodiments, components other than threaded materials that may be woven into sock 1300 may form the construction of ankle support assemblage 1311. For example, and without limiting the scope of the present invention, padded materials, silicon, rubber or other materials may be used and or implemented with ankle support assemblage 1311 (including implementation of the same into one or more of strips 1311*a*, 1311*b* and wrap 1311*c*) in order to provide a desired stiffness and thus desired support for the target region of the foot.

Figure 14A:
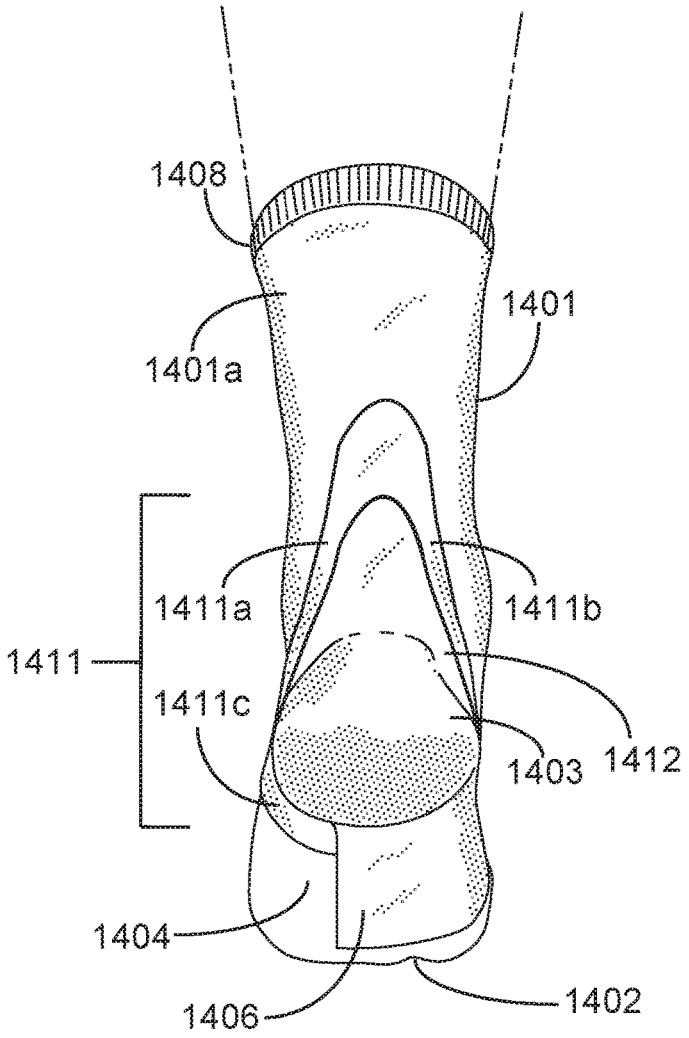
FIG. 14(*a*) is a back view of a sock in accordance with an exemplary embodiment of the present invention.
Figure 14B:
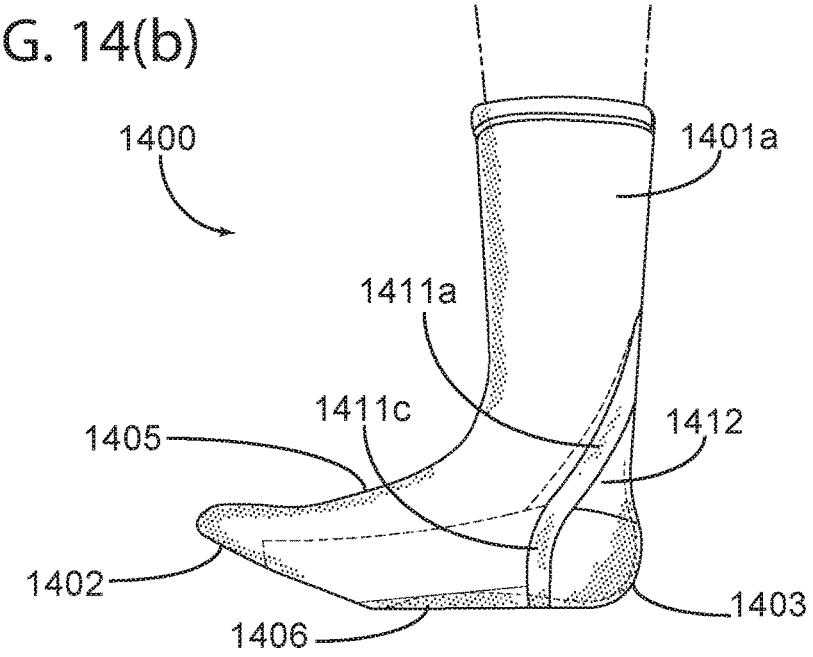

Turning to the next set of figures, FIG. 14(*a*) is a back view of a sock 1400 in accordance with an exemplary embodiment of the present invention; FIG. 14(*b*) is a side view thereof. More specifically, FIGS. 14(*a*)-14(*b*) depict sock 1400, which includes similar components as those found in the embodiment, of FIG. 13(*a*)-FIG. 13(*b*), except the embodiment of FIG. 14(*a*)-FIG. 14(*b*) exclude an Achilles support assemblage similar to that of sock 1300. Accordingly, sock 1400 may include sock body 1401 defined by a toe section 1402, a heel flap 1403, a sole 1404 extending between the toe section 1402 and the heel flap 1403 on a bottom portion of the sock 1400, and an instep 1405 extending between the toe section 1402 and the heel flap 1403 on a top portion of the sock, the toe section 1402 and instep 1405 having a first elasticity coefficient.

Although sock 1400 excludes an Achilles support assemblage, sock 1400 includes an arch support assemblage 1406 situated below the instep 1405, in front of the heel flap 1403, and behind the toe 1402, the arch support assemblage and adapted to cover an arch region of the sole 1404 of the sock 1400 excluding the toe section 1402 of the sock 1400 and in some embodiments as shown also excluding the heel flap 1403 of sock 1400 as well as the remainder of sole 1404, the arch support assemblage 1406 having a second elasticity coefficient, wherein the second elasticity coefficient is lower than the first elasticity coefficient such that this region of the sock comprises a stiffer more resilient structure.

Moreover, sock 1400 includes an ankle support assemblage 1411. In some exemplary embodiments such as the one depicted in these figures, Ankle support assemblage 1411 comprises a pair of bands or strips 1411*a* and 1411*b* extending from a distal end of the heel flap 1403 of the sock 1400 to posterior region of the sock above the heel flap. In some exemplary embodiments, strips 1411*a* and 1411*b* are joined together into a single band at the posterior region of the sock above the heel flap. Generally, strips 1411*a* and 1411*b* are adapted to cover a portion of an ankle of the wearer of the sock (see for example FIG. 14(*b*)). More specifically, a first strip 1411*a* may be a peroneal strip adapted to partially cover or run adjacent to an outer portion of the ankle of the wearer, or more specifically cover a portion of the peroneal tendons that run behind the lateral malleolus or the bony bit on the outside of the outer ankle. On the opposite side of sock 1400, a second strip 1411*b* may be a posterior tibial strip adapted to partially cover or run adjacent to an inner portion of the ankle of the wearer, or more specifically cover a portion of the posterior tibialis tendon that wraps around the inside of the ankle (medial malleolus) and instep of the foot of the wearer. In exemplary embodiments, each of peroneal strip 1411*a* and posterior tibial strip 1411*b* may have an elasticity coefficient that is lower than an elasticity coefficient of the remaining of the sock body 1401. As such, the portion of the sock body outside of strips 1411*a* and 1411*b*, including the space formed between each strip and the heel flap or space 1412, will have a higher elasticity coefficient than each strip 1411*a* and 1411*b* since each strip comprises a denser or more rigid construction.

In exemplary embodiments, as shown in FIG. 14(*a*) and FIG. 14(*b*), ankle support assemblage 1411 further comprises a third strip or wrap 1411*c*, which may be a peroneal tendon wrap that wraps around the sole 1404 of the sock 1400 connecting with a posterior region of the arch support assemblage 1406. More specifically, wrap 1411*c* wraps along the outer side of the sock 1400 and underneath the wearer's heel such that the peroneal tendon wrap 1411*c* connects the heel flap 1403 to the arch support assemblage 1406.

In some exemplary embodiments, ankle support assemblage 1411 has an elasticity coefficient that is lower than the elasticity coefficient of the sock body 1401. In some exemplary embodiments, ankle support assemblage 1411 has an elasticity coefficient that is equal to the elasticity coefficient of the arch support assemblage 1406. In some exemplary embodiments, ankle support assemblage 1411 has an elasticity coefficient that is lower than the elasticity coefficient of the sock body 1401, but not necessarily equal to an elasticity coefficient of arch support assemblage 1406.

In exemplary embodiments, each of strips 1411*a* and 1411*b* as mentioned above form a single strip; similarly, in some exemplary embodiments, each of strips 1411*a* and 1411*b* and wrap 1411*c* are constructed as a unitary component. In other exemplary embodiments, each strip or component is constructed separately and connected during construction of the sock. In exemplary embodiments, each of strips 1411*a* and 1411*b* and wrap 1411*c* may have have a lower elasticity coefficient than the rest of the sock (albeit arch support assemblage 1406) since each strip or wrap comprises a denser or more rigid construction.

Ankle support assemblage 1411 is almost entirely above the sole with the exception of peroneal tendon wrap 1411*c*, which together with perimetric boundary 1406*c* of arch support assemblage 1406 touch a distal end of heel flap 1404 situated at a bottom portion of sock 1400 along sole 1404.

Materials and construction of ankle support assemblage 1411 may vary without deviating from the scope of the present invention. In some embodiments, ankle support assemblage 1411 (including as mentioned above strips 1411*a*, 1411*b* and wrap 1411*c*) comprises a denser weave than the remaining regions of sock 1400, although it does not employ the oft-used terry loops, as the terry loop weave is much better fit for cushioning than providing structural support and stability.

In other exemplary embodiments, ankle support assemblage 1411 may employ tuck stitching to achieve a denser weave in which a given sock segment may have multiple rows of stitching overlain. The sock 1400 may employ terry loops elsewhere in the sock, where perhaps support and stability are not the goal. Accordingly, ankle support assemblage 1411 is typically stiffer than other parts of the sock. In some exemplary embodiments, components other than threaded materials that may be woven into sock 1400 may form the construction of ankle support assemblage 1411. For example, and without limiting the scope of the present invention, padded materials, silicon, rubber or other materials may be used and or implemented with ankle support assemblage 1411 (including implementation of the same into one or more of strips 1411*a*, 1411*b* and wrap 1411*c*) in order to provide a desired stiffness and thus desired support for the target region of the foot.

Figure 15A:
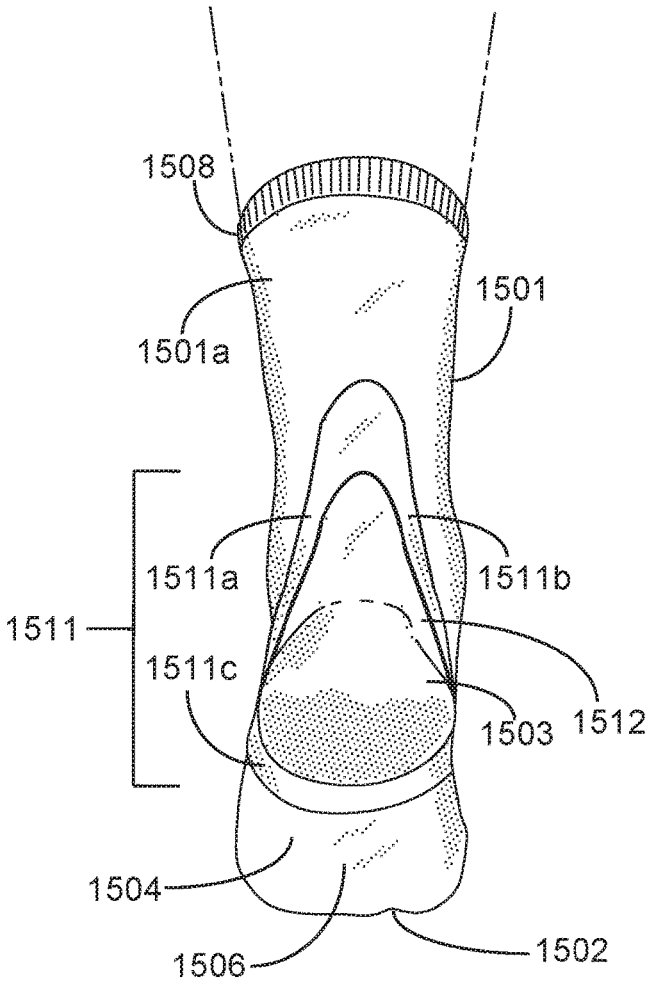
FIG. 15(*a*) is a back view of a sock in accordance with an exemplary embodiment of the present invention.
Figure 15B:
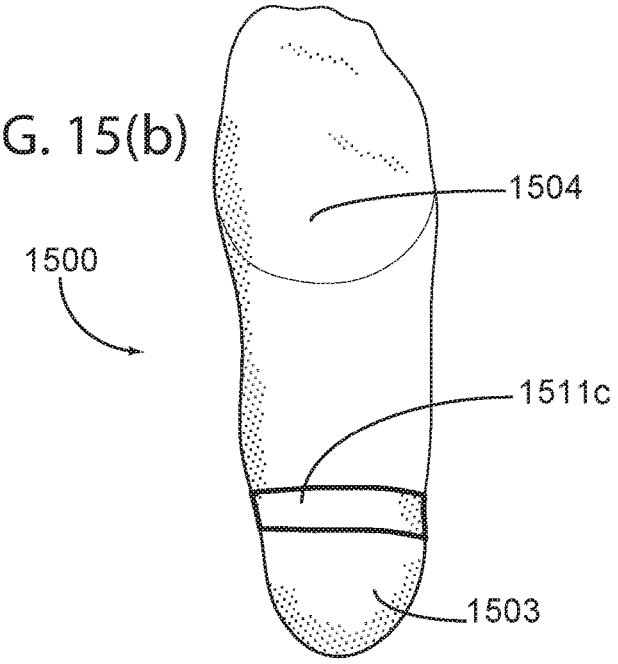

Turning to the last set of figures, FIG. 15(*a*) is a back view of a sock 1500 in accordance with an exemplary embodiment of the present invention; and FIG. 15(*b*) is a bottom view thereof. More specifically, FIGS. 15(*a*)-15(*b*) depict sock 1500, which includes similar components as those found in the embodiment of FIG. 14(*a*)-FIG. 14(*b*), except the embodiment of FIG. 15(*a*)-FIG. 15(*b*) further exclude an arch support assemblage similar to that of sock 1400. Accordingly, sock 1500 may include sock body 1501 defined by a toe section 1502, a heel flap 1503, a sole 1504 extending between the toe section 1502 and the heel flap 1503 on a bottom portion of the sock 1500, and an instep (not shown) extending between the toe section 1502 and the heel flap 1503 on a top portion of the sock, the toe section 1502 and the instep having a first elasticity coefficient.

Sock 1500 includes an ankle support assemblage 1511. In some exemplary embodiments such as the one depicted in these figures, Ankle support assemblage 1511 comprises a pair of bands or strips 1511*a* and 1511*b* extending from a distal end of the heel flap 1503 of the sock 1500 to posterior region of the sock above the heel flap. In some exemplary embodiments, strips 1511*a* and 1511*b* are joined together into a single band at the posterior region of the sock above the heel flap connected a portion or strap 1511*c* at the bottom of the sock and more specifically at a distal end of the heel flap 1503 of the sock 1500. Generally, strips 1511*a* and 1511*b* are adapted to cover a portion of an ankle of the wearer of the sock. More specifically, a first strip 1511*a* may be a peroneal strip adapted to partially cover or run adjacent to an outer portion of the ankle of the wearer, or more specifically cover a portion of the peroneal tendons that run behind the lateral malleolus or the bony bit on the outside of the outer ankle. On the opposite side of sock 1500, a second strip 1511*b* may be a posterior tibial strip adapted to partially cover or run adjacent to an inner portion of the ankle of the wearer, or more specifically cover a portion of the posterior tibialis tendon that wraps around the inside of the ankle (medial malleolus) and instep of the foot of the wearer. In exemplary embodiments, each of peroneal strip 1511*a* and posterior tibial strip 1511*b* may have an elasticity coefficient that is lower than an elasticity coefficient of the remaining of the sock body 1501. As such, the portion of the sock body outside of strips 1511*a* and 1511*b*, including the space formed between each strip and the heel flap or space 1512, will have a higher elasticity coefficient than each strip 1511*a* and 1511*b* since each strip comprises a denser or more rigid construction.

In exemplary embodiments, as shown in FIG. 15(*a*) and FIG. 15(*b*), ankle support assemblage 1511 further comprises a third strip or wrap 1511*c*, which may be a peroneal tendon wrap that wraps around the sole 1504 of the sock 1500 connecting each of each of strip 1511*a* and 1511*b* from one side of the sock to the other. More specifically, wrap 1511*c* wraps along the outer bottom sides of the sock 1500 and underneath the wearer's heel.

In exemplary embodiments, each of strips 1511*a* and 1511*b* as mentioned above form a single strip; similarly, in some exemplary embodiments, each of strips 1511*a* and 1511*b* and wrap 1511*c* are constructed as a unitary component. In other exemplary embodiments, each strip or component is constructed separately and connected during construction of the sock. In exemplary embodiments, each of strips 1511*a* and 1511*b* and wrap 1511*c* may have a lower elasticity coefficient than the rest of the sock including the heel flap 1503 since each strip or wrap comprises a denser or more rigid construction.

FIG. 15(*b*) is a bottom view of the sock depicted in FIG. 15(*a*). From this view, it may be appreciated how the peroneal tendon wrap 1511*c* connects both strips 1511*a* and 1511*b* by wrapping around a bottom region of the sock at a distal end of the heel flap 1503. In accordance with some exemplary embodiments of the present invention, sole 1505 may include a first region that has a higher elasticity coefficient than a second region, wherein the second region includes the peroneal tendon wrap 1511*c* of ankle support assemblage 1511, but excludes heel flap 1502 (i.e. heel flap 1505 may have in some exemplary embodiments an elasticity coefficient equal to that of the first region or sole 1505, or heel flap 1505 may have a lower elasticity coefficient than sole 1504 but nonetheless higher elasticity coefficient than the peroneal tendon wrap 1511*c* of ankle support assemblage 1511.

Materials and construction of ankle support assemblage 1511 may vary without deviating from the scope of the present invention. In some embodiments, ankle support assemblage 1511 (including as mentioned above strips 1511*a*, 1511*b* and wrap 1511*c*) comprises a denser weave than the remaining regions of sock 1500, although it does not employ the oft-used terry loops, as the terry loop weave is much better fit for cushioning than providing structural support and stability.

In other exemplary embodiments, ankle support assemblage 1511 may employ tuck stitching to achieve a denser weave in which a given sock segment may have multiple rows of stitching overlain. The sock 1500 may employ terry loops elsewhere in the sock, where perhaps support and stability are not the goal. Accordingly, ankle support assemblage 1511 is typically stiffer than other parts of the sock. In some exemplary embodiments, components other than threaded materials that may be woven into sock 1500 may form the construction of ankle support assemblage 1511. For example, and without limiting the scope of the present invention, padded materials, silicon, rubber or other materials may be used and or implemented with ankle support assemblage 1511 (including implementation of the same into one or more of strips 1511*a*, 1511*b* and wrap 1511*c*) in order to provide a desired stiffness and thus desired support for the target region of the foot.

A sock with one or more support assemblages, which provides additional structural support and stability to one or more regions of the foot, has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

DESCRIPTION OF THE REFERENCE SYMBOLS

100: Foot
102: Fibula
104: Tibia
106: Talus
108: Navicular
110: Cuneiforms
112: Calcaneus
114: Cuboid
116: Metatarsals
118: Phalanges
220: Lateral ball
222: Medial ball
224: Transverse arch
226: Lateral longitudinal arch
228: Medial longitudinal arch
230: Arch region
250: Arch support assemblage
332: Heel
334: Flat arch
436: Sock
438: Sock leg
440: Heel flap
442: Arch support assemblage
444: Sock instep
446: Sock toe
848: Medial longitudinal support
850: Lateral longitudinal support
852: Transverse support
854: Heel support
900: Foot
901: Achilles tendon
902: Calcaneus
903: Posterior tibialis tendon
904: Instep
905: Flexor digitorum longus tendon
906: Retrocalcaneal bursa
907: Retroachilles bursa
908: Flexor hallucis longus tendon
909: Flexor retinaculum
910: Sole
1000: Sock
1001: Sock body
1002: Toe section
1003: Heel flap
1004: Sole
1005: Instep
1006: Arch support assemblage
1007: Achilles support assemblage
1008: Cuff

1009: First region
1010: Second region
1011: Layer
1100: Sock
1101: Sock body
1102: Toe section
1103: Heel flap
1104: Sole
1105: Instep
1106: Arch support assemblage
1107: Achilles support assemblage
1108: Cuff
1109: First region
1110: Second region
1111: Layer
1200: Sock
1201: Achilles support assemblage
1202: Lateral bands or strips
1202*a*: First terminal end strip
1202*b*: Second terminal end strip
1202*c*: Spacing (between lateral bands or strips)
1203: Height of the leg
1204: Heel flap
1205: Heel flap lip
1206: Arch support assemblage
1207: Layer
1208: Edge of cuff
1300: Sock
1301: Sock body
1301*a*: Leg
1302: Toe section
1303: Heel flap
1304: Sole
1305: Instep
1306: Arch support assemblage
1307: Achilles support assemblage
1308: Cuff
1309: First region
1310: Second region
1311: Ankle support assemblage
1311*a*: Peroneal strip
1311*b*: Posterior tibial strip
1311*c*: Peroneal tendon wrap
1400: Sock
1401: Sock body
1401*a*: Leg
1402: Toe section
1403: Heel flap
1404: Sole
1405: Instep
1406: Arch support assemblage
1408: Cuff
1411: Ankle support assemblage
1411*a*: Peroneal strip
1411*b*: Posterior tibial strip
1411*c*: Peroneal tendon wrap
1412: Space
1500: Sock
1501: Sock body
1501*a*: Leg
1502: Toe section
1503: Heel flap
1504: Sole
1508: Cuff
1511: Ankle support assemblage
1511*a*: Peroneal strip
1511*b*: Posterior tibial strip
1511*c*: Peroneal tendon wrap
1512: Space

What is claimed is:

1. A sock, comprising:

a sock body defined by a toe section, a heel flap, a sole extending between the toe section and the heel flap on a bottom portion of the sock, and an instep extending between the toe section and the heel flap on a top portion of the sock, the toe section and the instep having a first elasticity coefficient;

an arch support assemblage, situated below the instep, in front of the heel flap, and behind the toe, the arch support assemblage adapted to cover an arch region of the sole of the sock excluding the toe section of the sock, the arch support assemblage having a second elasticity coefficient, wherein the second elasticity coefficient is lower than the first elasticity coefficient such that the arch support assemblage is stiffer than the toe section, the instep, and the leg of the sock; and an ankle support assemblage adapted to cover a portion of an ankle of a wearer of the sock, wherein the ankle support assemblage is defined by:

a first strip that is a peroneal strip adapted to partially cover or run adjacent to an outer portion of the ankle of the wearer; a second strip on the opposite side of the sock that is a posterior tibial strap adapted to partially cover or run adjacent to an inner portion of the ankle of the wearer; and a third strip that is a peroneal tendon wrap that wraps around the sole of the sock connecting with a posterior region of the arch support assemblage; wherein the ankle support assemblage is adapted to unwrap around a talus or a metatarsus of a foot of the wearer.

2. The sock of claim 1, wherein the ankle support assemblage has an elasticity coefficient that is lower than the first elasticity coefficient.

3. The sock of claim 1, wherein the ankle support assemblage has an elasticity coefficient that is equal to the second elasticity coefficient.

4. The sock of claim 1, wherein the heel flap of the sock has an elasticity coefficient that is lower than the first elasticity coefficient.

5. The sock of claim 1, wherein the heel flap of the sock has an elasticity coefficient that is equal to the second elasticity coefficient.

6. A sock, comprising:

a sock body defined by a toe section, a heel flap, a sole extending between the toe section and the heel flap on a bottom portion of the sock, and an instep extending between the toe section and the heel flap on a top portion of the sock, the toe section and the instep having a first elasticity coefficient;

an arch support assemblage, situated below the instep, in front of the heel flap, and behind the toe section, the arch support assemblage adapted to cover an arch region of the sole of the sock excluding the toe section of the sock, the heel flap of the sock as well as the remainder of the sole, the arch support assemblage having a second elasticity coefficient that is lower than the first elasticity coefficient such that the arch support assemblage is stiffer than the toe section, the instep, and a leg of the sock; wherein the arch support assemblage is defined by:

a first perimetric boundary that runs longitudinally along a middle portion of the sole of the sock between an outer region adapted to cover a lateral ball of a foot and an inner region adapted to cover a medial ball of the foot, so that the arch support assemblage substantially excludes the outer region of the sole of the sock; and a second perimetric boundary that runs substantially parallel to the first perimetric boundary and longitudinally along a border of the inner region of the sole of the sock adapted to cover the medial ball of the foot, so that the arch support assemblage partially covers the inner region of the sole of the sock, excludes the toe of the sock, and the heel flap of the sock; and an ankle support assemblage adapted to cover a portion of an ankle of a wearer of the sock; wherein the ankle support assemblage is comprised of a first strip, a second strip, and a third strip.

7. The sock of claim 6, wherein the first strip is a peroneal strip adapted to partially cover or run adjacent to an outer portion of the ankle of the wearer.

8. The sock of claim 6, wherein the second strip is a posterior tibial strap adapted to partially cover or run adjacent to an inner portion of the ankle of the wearer.

9. The sock of claim 6, wherein the third strip is a peroneal tendon strip that wraps around the sole of the sock connecting with a posterior region of the arch support assemblage and the heel flap.

10. The sock of claim 6, wherein the ankle support assemblage has an elasticity coefficient that is lower than the first elasticity coefficient.

11. The sock of claim 6, wherein the ankle support assemblage has an elasticity coefficient that is equal to the second elasticity coefficient.

12. The sock of claim 6, wherein the heel flap of the sock has an elasticity coefficient that is lower than the first elasticity coefficient.

13. The sock of claim 6, wherein the heel flap of the sock has an elasticity coefficient that is equal to the second elasticity coefficient.

* * * * *